US005979569A

United States Patent [19]

Heller

[11] Patent Number: 5,979,569

[45] **Date of Patent: *Nov. 9, 1999**

[54] METHOD AND APPARATUS FOR ENVIRONMENTAL SAMPLING

[75] Inventor: Noah Heller, Mill Valley, Calif.

[73] Assignee: Simulprobe Technologies, Inc., Mill Valley, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/554,128

[22] Filed: Nov. 6, 1995

Related U.S. Application Data

[63] Continuation-in-part of application No. 08/403,371, Mar. 15, 1995, Pat. No. 5,743,343, which is a continuation-in-part of application No. 08/124,789, Sep. 21, 1993, Pat. No. 5,421,419.

[51] Int. Cl.[6] ..... E21B 49/02; E21B 49/08

[52] U.S. Cl. ..... 175/20; 175/59; 166/169; 166/264

[58] Field of Search ..... 175/20, 59, 58; 166/264, 169, 162; 73/864.63, 864.64, 864.44

[56] References Cited

U.S. PATENT DOCUMENTS

| | | | |
|---|---|---|---|
| 763,212 | 6/1904 | Shuman | 175/23 |
| 1,737,256 | 11/1929 | McQuiston | 175/58 |
| 1,896,703 | 2/1933 | Dean | 175/249 |
| 2,167,991 | 8/1939 | Oliver | 175/404 |
| 2,283,650 | 5/1942 | Sanborn | 255/1.4 |
| 2,313,576 | 3/1943 | Phillips et al. | 175/249 |
| 2,382,992 | 8/1945 | Harris | 255/1.4 |
| 2,664,269 | 12/1953 | Knight et al. | 255/1 |
| 2,751,010 | 6/1956 | Trahan | 175/249 |
| 2,941,405 | 6/1960 | Southwick | 166/264 |
| 3,016,096 | 1/1962 | Spalding | 166/332 |
| 3,047,081 | 7/1962 | Pitcher | 175/239 |
| 3,064,742 | 11/1962 | Bridwell | 175/59 |
| 3,095,930 | 7/1963 | Kisling, III | 73/864.63 |
| 3,139,147 | 6/1964 | Hays et al. | 166/264 X |
| 3,151,681 | 10/1964 | Cochran | 166/332 |
| 3,318,394 | 5/1967 | Gleason et al. | 175/5 |
| 3,367,188 | 2/1968 | Robinson | 175/20 |
| 3,412,814 | 11/1968 | Rosfelder | 175/6 |
| 3,447,615 | 6/1969 | Schick | 175/17 |
| 3,530,933 | 9/1970 | Whitten | 166/100 |
| 3,685,345 | 8/1972 | Wise | 73/19 |
| 3,794,127 | 2/1974 | Davis | 175/58 |
| 3,805,900 | 4/1974 | Sainsbury | 175/249 |
| 4,098,360 | 7/1978 | Clements | 175/313 |
| 4,317,490 | 3/1982 | Milberger et al. | 175/20 |

(List continued on next page.)

FOREIGN PATENT DOCUMENTS

| | | | |
|---|---|---|---|
| 910292 | 9/1972 | Canada | 175/59 |
| 896 253 | 2/1945 | France | 175/58 |
| 713 982 | 2/1980 | Russian Federation | 175/244 |
| 1 177 444 | 9/1985 | Russian Federation | 175/59 |

OTHER PUBLICATIONS

Gillham, et al. "A Device for In Situ Determination of Geochemical Transport Parameters 1. Retardation"; Ground Water; vol. 28, No. 5; Sep.–Oct. 1990; pp. 666–672.

Gillham, et al. "A Device for In Situ Determination of Geochemical Transport Parameters 2. Biochemical Reactions" Gound Water; Vo. 28, No. 6; Nov.–Dec. 1990; pp. 858–862.

*Primary Examiner*—Hoang C. Dang
*Attorney, Agent, or Firm*—Limbach & Limbach L.L.P.

[57] ABSTRACT

A sampling device having a fluid collecting portion adapted to recover a fluid sample from a subsurface. Fluid entering the fluid collecting portion passes through a valve which may be remotely actuated. After the sampling device has been driven into the subsurface and a fluid sample has been collected in the fluid collecting portion, the valve is closed to prevent cross-contamination of the fluid sample in the fluid collecting portion.

10 Claims, 18 Drawing Sheets

U.S. PATENT DOCUMENTS

| | | | |
|---|---|---|---|
| 4,335,622 | 6/1982 | Bartz | 73/864.74 |
| 4,452,091 | 6/1984 | Richers | 73/864.52 |
| 4,518,050 | 5/1985 | Sollie et al. | 175/250 |
| 4,518,051 | 5/1985 | Sollie et al. | 175/250 |
| 4,588,036 | 5/1986 | Desrochers et al. | 175/58 |
| 4,669,554 | 6/1987 | Cordry | 175/59 |
| 4,729,437 | 3/1988 | Zapico | 175/20 |
| 4,809,790 | 3/1989 | Manchak, Jr. | 175/17 |
| 4,884,439 | 12/1989 | Baird | 166/264 X |
| 4,928,541 | 5/1990 | Toon et al. | 73/864.63 |
| 4,953,637 | 9/1990 | Starr et al. | 175/20 |
| 5,046,568 | 9/1991 | Cordry | 175/21 |
| 5,146,998 | 9/1992 | Cordry et al. | 175/21 |
| 5,186,263 | 2/1993 | Kejr et al. | 175/20 |
| 5,211,249 | 5/1993 | Ritcher et al. | 175/20 |
| 5,289,887 | 3/1994 | Puttmann | 175/135 X |
| 5,355,966 | 10/1994 | Mathis | 175/135 X |
| 5,417,122 | 5/1995 | Casey et al. | 73/864.44 |
| 5,421,419 | 6/1995 | Heller et al. | 175/20 |
| 5,743,343 | 4/1998 | Heller et al. | 175/20 |

METHOD AND APPARATUS FOR ENVIRONMENTAL SAMPLING

This is a Continuation-In-Part of U.S. Ser. No. 08/403,371, filed Mar. 15, 1995, now U.S. Pat. No. 5,743,343 which was a Continuation-In-Part of U.S. Ser. No. 08/124,789, filed Sep. 21, 1993, now U.S. Pat. No. 5,421,419.

BACKGROUND OF THE INVENTION

The present invention relates to the field of fluid and soil sampling methods and apparatus. Modern industries produce contaminants which are often released onto land. The contaminants migrate downward into the subsurface creating potential health risks. Contaminant remediation plans are implemented to remove soil and ground water contamination.

Designing a remediation plan typically requires collecting soil and fluid samples to determine the extent of subsurface contamination. The term fluid as used herein refers to both gas and liquid. Soil samples provide subsurface data including contaminant concentration for inorganic and organic compounds, grain size, mineral composition, texture, density, permeability and porosity. Fluid samples are analyzed to determine contaminant concentration, organic chemistry in the case of soil gas, and both organic and inorganic chemistry in the case of liquid.

A conventional method of retrieving a fluid sample is described in U.S. Pat. No. 4,669,554 to Cordry. The sampling device includes a sample chamber which has two check valves. One of the check valves permits groundwater to enter the sample chamber and one of the check valves permits ground water to exit the sample chamber. Groundwater enters the sampling device through a tube having openings therethrough. In use, the device is driven into the subsurface to the desired sampling depth. When the sampling device reaches the desired sampling depth, the device is pulled toward the uphole end so that the body separates from the cone assembly and the tube is exposed. Groundwater then passes through the tube and check valve and into the sample chamber. The device is then pulled out of the ground with the groundwater sample being retained in the sample chamber.

A problem which occurs when using the sampling device disclosed in U.S. Pat. No. 4,669,554, and other conventional groundwater sampling devices is that cross-contamination of the groundwater sample may occur. When the groundwater sample is collected, groundwater enters the sample chamber under the potentiometric head in the formation. When the device is withdrawn from the subsurface, the tube is still exposed and groundwater from different vertical depths may enter the tube and displace the groundwater sample from the desired depth. The check valve is not adapted to stop groundwater flow into the chamber when the device is removed from the ground.

The problem of cross-contamination of the groundwater sample is particularly troublesome when the sampling device is removed from the subsurface since the fluid in the borehole may replace the collected sample. The borehole is normally filled with turbid water which contains suspended solids or drilling mud which increase the specific gravity of the fluid in the borehole. The high specific density borehole fluids may, therefore, pass through the check valve and into the fluid collecting portion thereby contaminating the fluid sample.

SUMMARY OF THE INVENTION

The problems associated with prior art fluid sampling methods and apparatus are overcome in accordance with the method and apparatus of the present invention. A sampling device is provided which includes a valve which may be remotely actuated.

The sampling device includes a groundwater collecting portion coupled to a fluid entrance. The valve is positioned along the fluid path between the fluid entrance and the groundwater collecting portion. The sampling device is driven into the subsurface and a fluid sample is collected in the fluid sampling portion. The valve is then closed to prevent both fluid flow into and fluid flow out of the groundwater collecting portion. In this manner, cross-contamination of the fluid sample is prevented when the sampling device is removed from the subsurface.

The valve is preferably a solenoid valve which is actuated from a position remote from the sampling device. The valve may, of course, be any other conventional valve including a pneumatically actuated valve.

Other features and advantages of the invention will appear from the following description in which the preferred embodiments have been set forth in detail in conjunction with the accompanying drawings.

DESCRIPTION OF THE PREFERRED EMBODIMENTS

Figure 1:
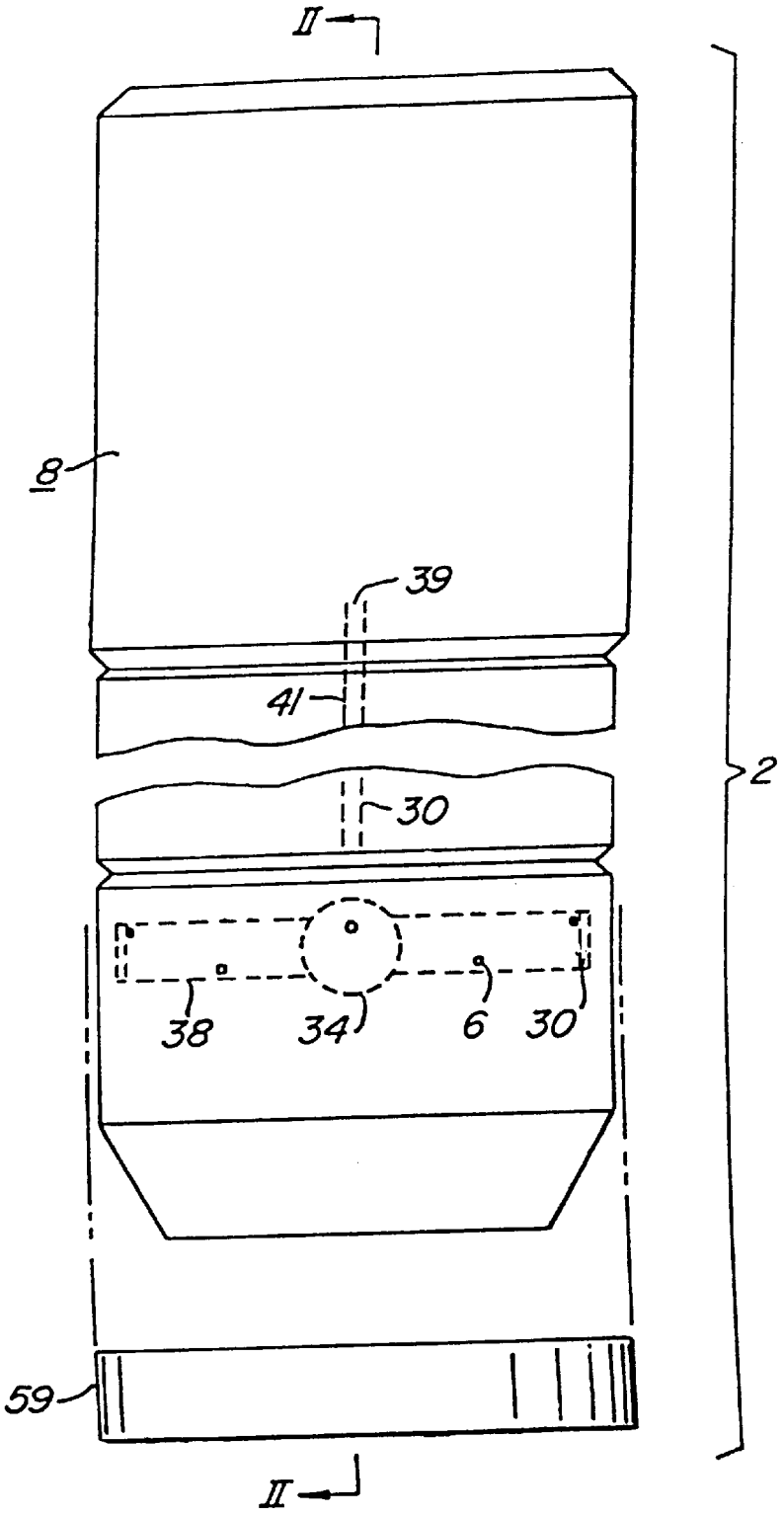
FIG. 1 is a side view of a soil and fluid sampling device.
Figure 2:
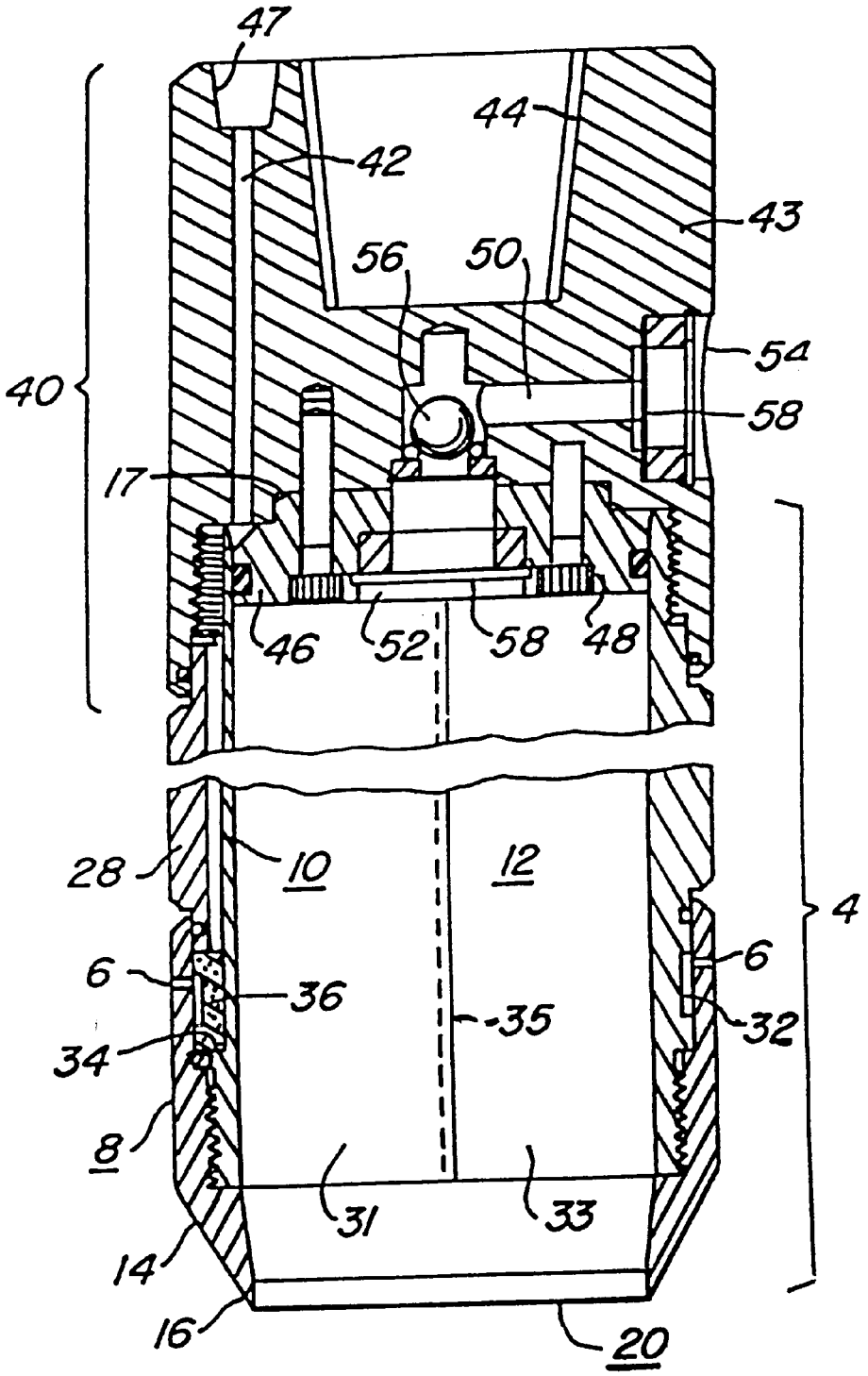
FIG. 2 is a cross-sectional view of the sampling device of FIG. 1 along line II—II.

A sampling device 2 for collecting a soil and a fluid sample includes a barrel 4 having an exterior surface 8 and an interior surface 10 (FIGS. 1 and 2). The exterior and interior surfaces 8, 10 may take any shape but are preferably generally cylindrical. A fluid entrance 6 penetrates the exterior surface 8 and is used to collect a fluid sample as described below.

The interior surface 10 of the barrel 4 defines a hollow interior 12. A soil sample is collected by driving the sampling device 2 into a subsurface so that the soil sample is forced into the hollow interior 12 of the barrel 4. The sampling device 2 is preferably driven into the subsurface by a wire line driven drive hammer or rod driven drive hammer (not shown). The sampling device 2 may also be driven into the formation by any other conventional method, such as rotary drilling.

Figure 5:
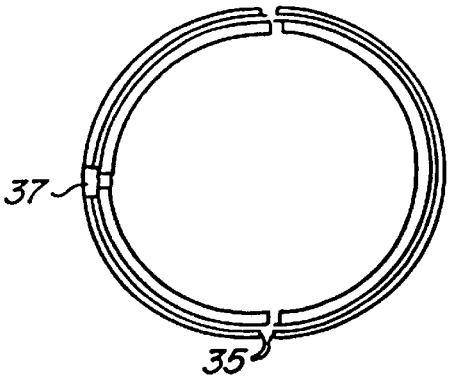
FIG. 5 is cross-sectional view of the sample tube of FIG. 3 along line V—V.
Figure 6:
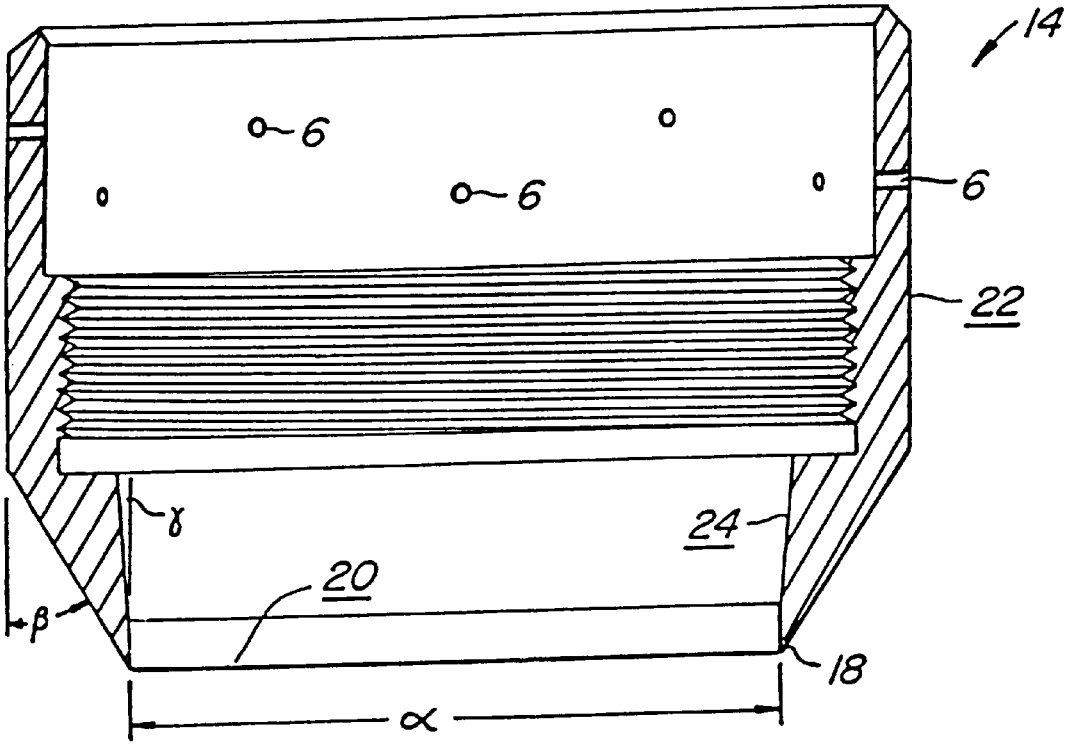
FIG. 6 is a cross-sectional view of a drive shoe.

The barrel 4 includes a sample tube 28 and a drive shoe 14 (FIG. 6) connected to the sample tube at a downhole end 16. The drive shoe 14 and sample tube 28 are preferably formed separately but may also be formed in one piece. The sample tube 28 is preferably split longitudinally along a split line 35 into first and second sections 31, 33 (FIGS. 5 and 6). The inner diameter of the sample tube is preferably in a range from about ½ to 6 inches, most preferably in a range of 1 to 4 inches and most preferably about 2½ inches when the hollow interior has a circular cross-section. If the hollow interior has any other cross-sectional shape, the area of the cross-sectional shape is preferably in a range of 0.79 to 113.10 square inches and most preferably in a range of 3.14 to 50.27 square inches. The first and second sections 31, 33 are secured together at the downhole end by the drive shoe 14 and at an uphole end 17 by a valve assembly 40. The valve assembly 40 includes an outer body 43 and an inner body 46 attached to the outer body 43 with bolts 48.

The drive shoe 14 has an angular cutting edge 18 for piercing the subsurface (FIG. 6). The angular cutting edge 18 defines an open end 20 leading to the hollow interior 12. The open end 20 preferably has a diameter $\alpha$ of about 2.375 inches but may range from about 1 inch to about 4 inches. The angular cutting edge 18 has an angle $\beta$ oriented about 30° from the outer surface 22 of the drive shoe (FIG. 6). An inner surface 24 of the drive shoe is oriented at an angle $\gamma$ which is about 3° with respect to a vertical axis 26 of the drive shoe. The drive shoe is preferably made of heat treated SAE 4140 steel. The preceding dimensions are preferred, however, any other drive shoe configuration may also be used.

Figure 8:
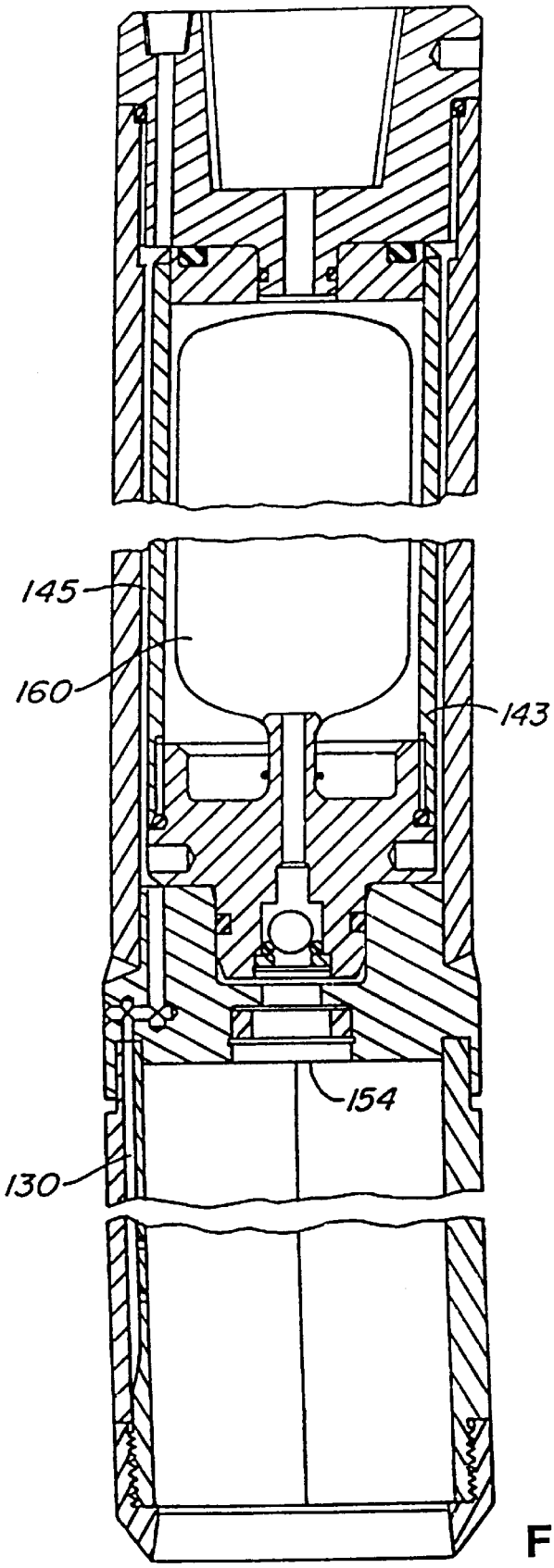
FIG. 8 is a cross-sectional view of the sampling device of FIG. 7 with the fluid entrances penetrating the interior surface of the barrel.

The sampling device preferably includes a plurality of fluid entrances 6 which penetrate the exterior surface 8 of the barrel 4. The fluid entrances 6 have a diameter of about 0.0062 inches and are configured in two rows of six fluid entrances circumferentially spaced around the barrel 4. The fluid entrances 6 are preferably positioned at the downhole end 16 but may be positioned anywhere along the barrel. The fluid entrance 6 may take many forms and shapes. For example, the fluid entrance may be a single slot circumscribing a substantial portion of the circumference, a large number of perforations, vertically disposed slots, or any combination thereof. The fluid entrance 6 preferably penetrates only the exterior surface 10 so that the soil sample within the hollow interior 12 is not chemically biased during collection of the fluid sample. The fluid entrance may, however, also penetrate the interior surface of the barrel (FIG. 8).

The fluid entrance 6 is fluidly coupled to an annular channel 32 formed between the drive shoe 14 and the sample tube 28. The annular channel 32 includes an enlarged filter cavity 34 which houses a filter 36. The filter cavity 34 has a generally larger cross-sectional flow area than the annular channel 32 to minimize flow resistance at the filter.

Figure 3:
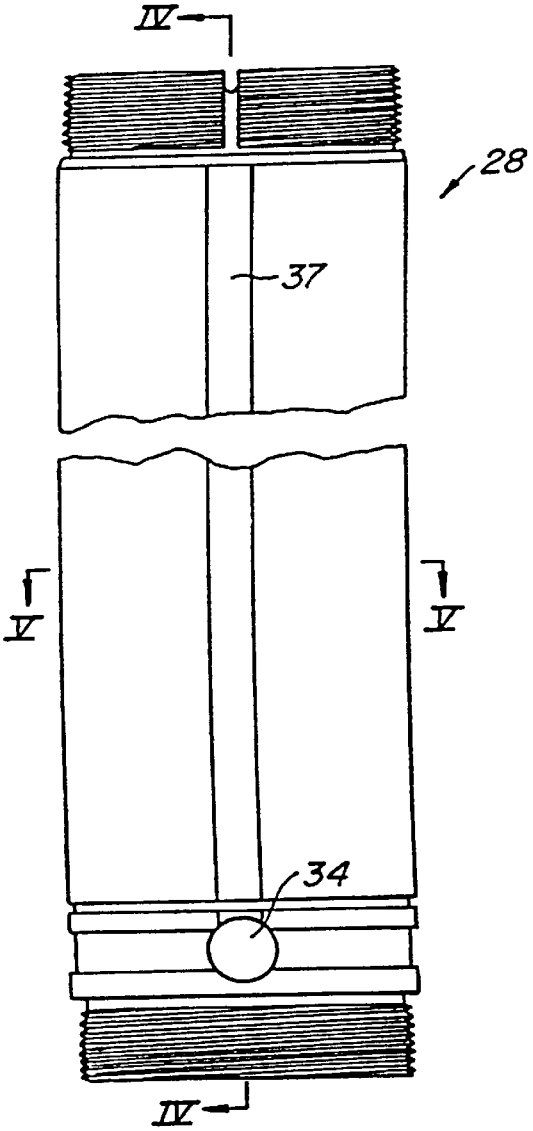
FIG. 3 is a side view of a sample tube.
Figure 4:
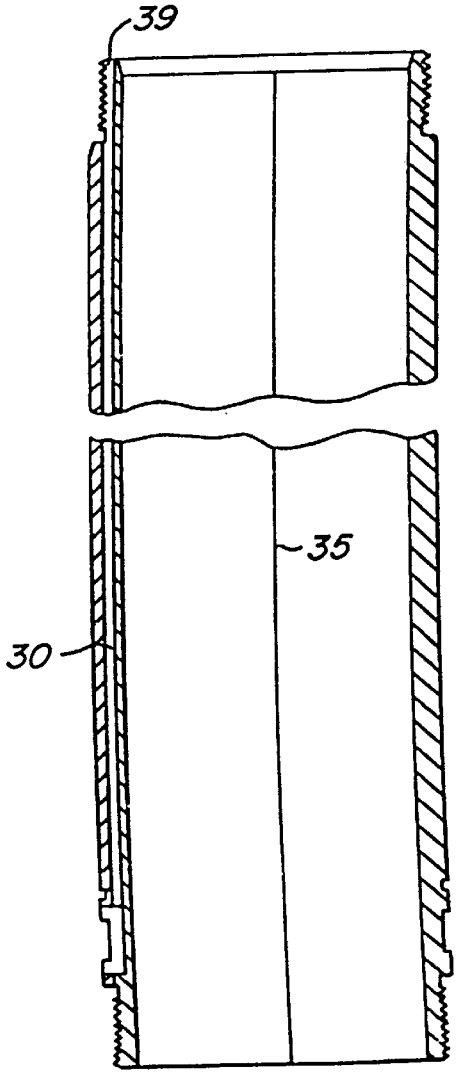
FIG. 4 is a cross-sectional view of the sample tube of FIG. 3 along line IV—IV.

The annular channel 32 is fluidly coupled to a longitudinal channel 30 at the filter cavity 34. The longitudinal channel 30 terminates at an outlet port 39 (FIGS. 2 and 3). The preferred embodiment includes a single channel 30, however, a number of channels may also be used. The channel 30 is formed by cutting a longitudinally T-shaped section into the barrel (FIG. 5). An outer piece 37 is then seal welded into the upper part of the T-shaped section thereby forming the channel 30 between the outer piece 37 and the sample tube 28. A stainless steel tube (not shown) may be brazed into the longitudinal channel 30 to facilitate cleaning and resist corrosion.

The annular channel 32, filter cavity 34, and channel 30 together define the fluid path 38 which is depicted by broken lines 41 in FIG. 1. The fluid path 38 terminates at the outlet port 39 of the barrel 4 (FIG. 2). The fluid path 38 may take many forms so long as it fluidly couples the fluid entrance 6 and the outlet port 39.

The valve assembly 40 is rigidly attached to an upper end of the sample tube 28 by a threaded connection or slip coupling. The valve assembly 40 includes a fluid sample path 42 coupled to the outlet port 39 of the sample tube (FIG. 2). The fluid sample path 42 terminates at an outlet connection 47. The outlet connection may be coupled to a vacuum pump (not shown) for extracting a soil gas sample. The outer body 43 of the valve assembly 40 also includes a threaded rod connection 44 (FIG. 2) for receiving a rod used to drive the sampling device 2 into the subsurface.

The valve assembly 40 houses a displaced air line 50 having an entrance port 52 and an exit port 54. The entrance port 52 opens into the hollow interior 12. A check valve 56, preferably a ball valve, is positioned along the displaced air line 50 between the entrance and exit ports. When the soil sample enters the hollow interior the air displaced by the soil sample is exhausted through the displaced air line 50. The entrance and exit ports 54 also include screens 58 which prevent particulate matter from entering the displaced air line 50. The screens 58 are preferably stainless steel mesh cloth.

A flow preventing mechanism prevents flow into the fluid entrance 6 before the barrel 4 is driven into the subsurface. The flow preventing mechanism ensures that cross-contamination of the fluid sample does not occur. A preferred flow preventing mechanism is an elastic band 59 sized to fit around the exterior surface of the barrel and positioned to cover the fluid entrance 6 (FIG. 1). As the barrel is driven into the subsurface, frictional engagement between the elastic band 59 and the subsurface displaces the elastic band toward the uphole end 17 thereby exposing the fluid entrance 6. The flow preventing mechanism may take many forms such as a flow prevention valve along the fluid path 38. A further flow preventing mechanism is described below in connection with FIGS. 9–13.

Figure 7:
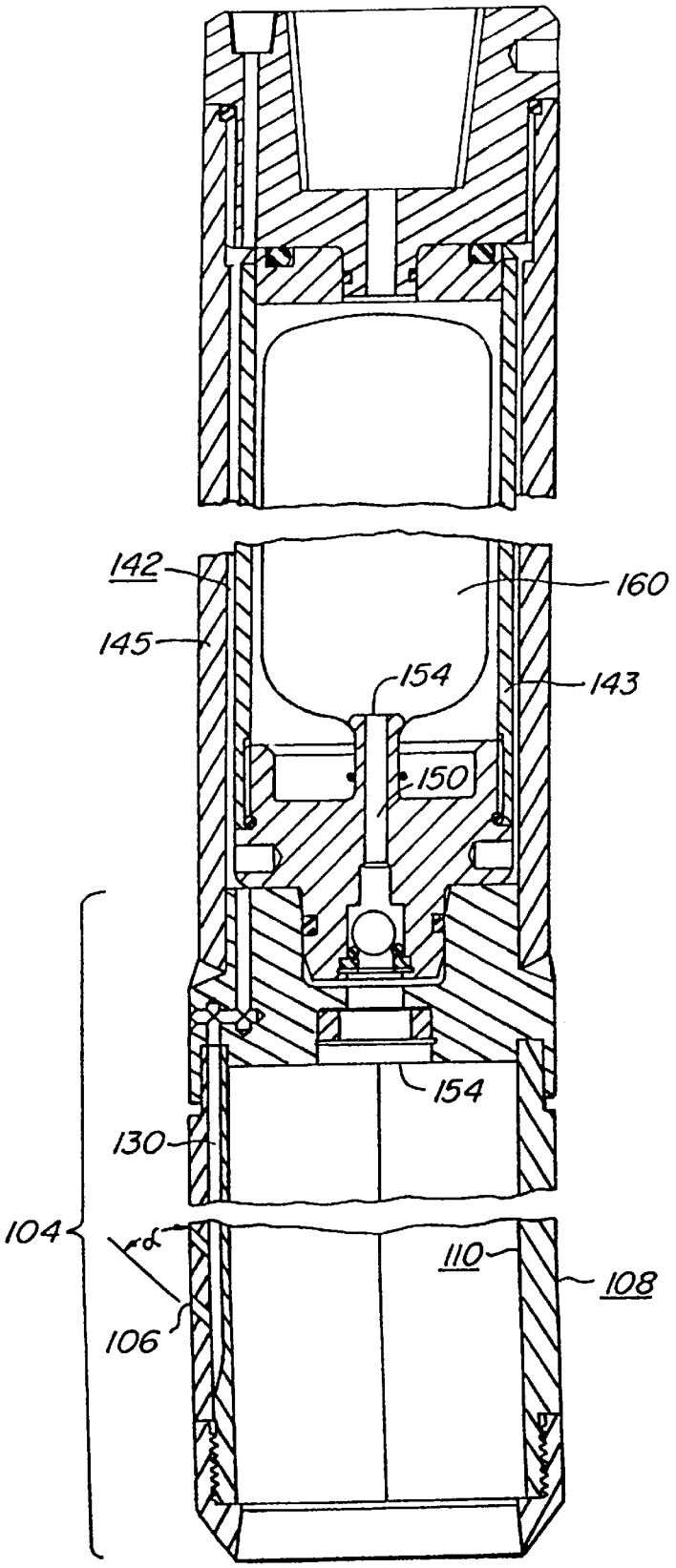
FIG. 7 is a cross-sectional view of a second embodiment of the soil and fluid sampling device.

A second embodiment of the invention is shown in FIG. 7. A sampling device 102 includes a plurality of fluid entrances 106 extending along the length of a longitudinal channel 130 and spaced at one inch intervals. The fluid entrance 106 has a diameter of 0.0062 inches and are at an angle δ of about 45° with respect to the exterior surface 108. The fluid entrance 106 may, of course, take any shape, size and angular orientation.

The longitudinal channel 130 is fluidly coupled to an annular path 142 defined between an outer wall 145 and an outer body 143. The outer body 143 houses a gas bladder 160 which is fluidly coupled to an exit port 154 of a displaced air line 150. The gas bladder stores the air which is displaced in the hollow interior by the soil sample. The gas bladder 160 is preferably evacuated prior to use. FIG. 8 illustrates shows the fluid entrance 106 for the sampling device 102 penetrating an interior surface 110 of the barrel 110 of the barrel 104. It is understood that any of the other embodiments disclosed herein may also optionally include a fluid entrance penetrating the interior surface.

A third embodiment of the invention is shown in FIGS. 9–13. A sampling device 202 includes a barrel 204 having a sample tube 228, a drive shoe 214 and an inner ring 262. Although the barrel is preferably formed in three parts it may also be formed in any number of parts. The sample tube 228 has first and second sections 231, 233 held together at a downhole end by the drive shoe 214 and inner ring 262 and at an uphole end by a valve assembly 240. A fluid entrance 206 penetrates the inner ring 262 and is used for collecting the fluid sample. Preferably a number of fluid entrances are provided circumferentially spaced around the barrel. As stated in the description of sampling device 2, the fluid entrance may take many forms but is preferably a circular hole having a diameter of about 0.06 inches.

Figure 9:
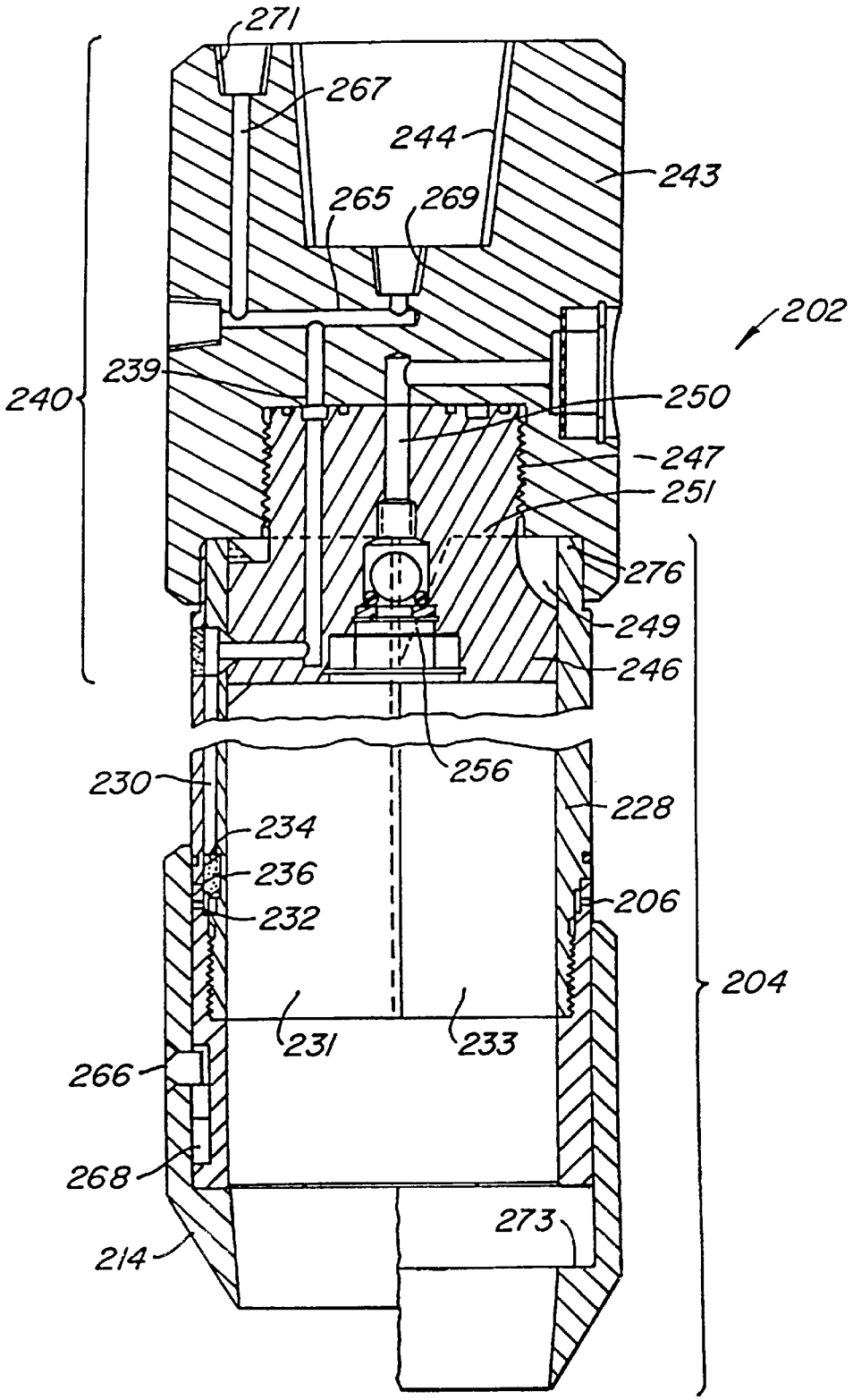
FIG. 9 is a cross-sectional view of a third embodiment of the soil and fluid sampling device with the drive shoe depicted in a first, retracted position, and a second, extended position.
Figure 10:
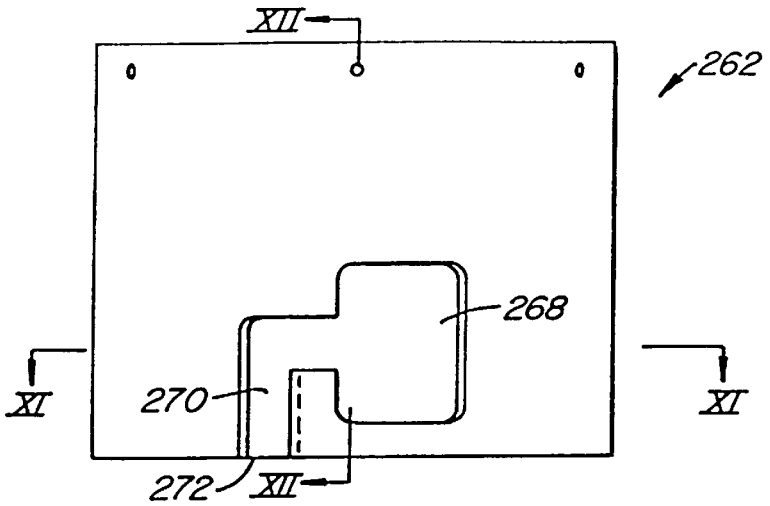
FIG. 10 is a side view of an inner ring.
Figure 11:
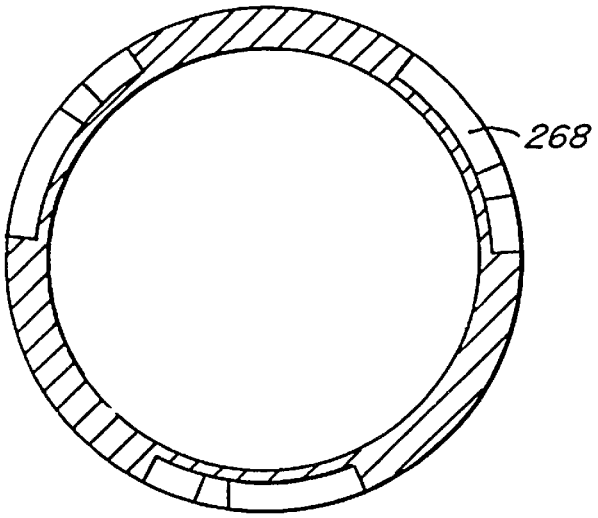
FIG. 11 is a cross-sectional view of the inner ring of FIG. 10 along line XI—XI.
Figure 12:
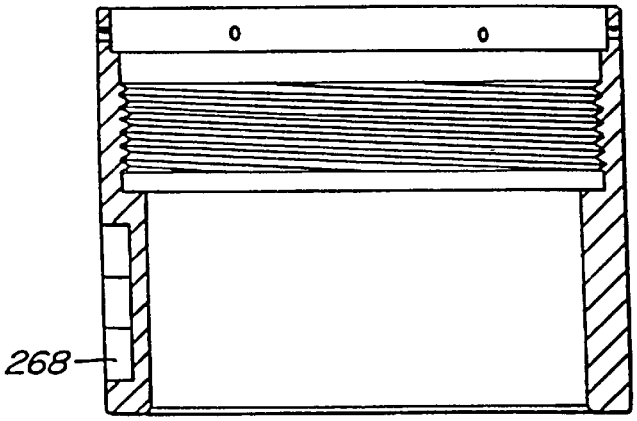
FIG. 12 is a cross-sectional view of the inner ring of FIG. 7 along line XII—XII.
Figure 13:
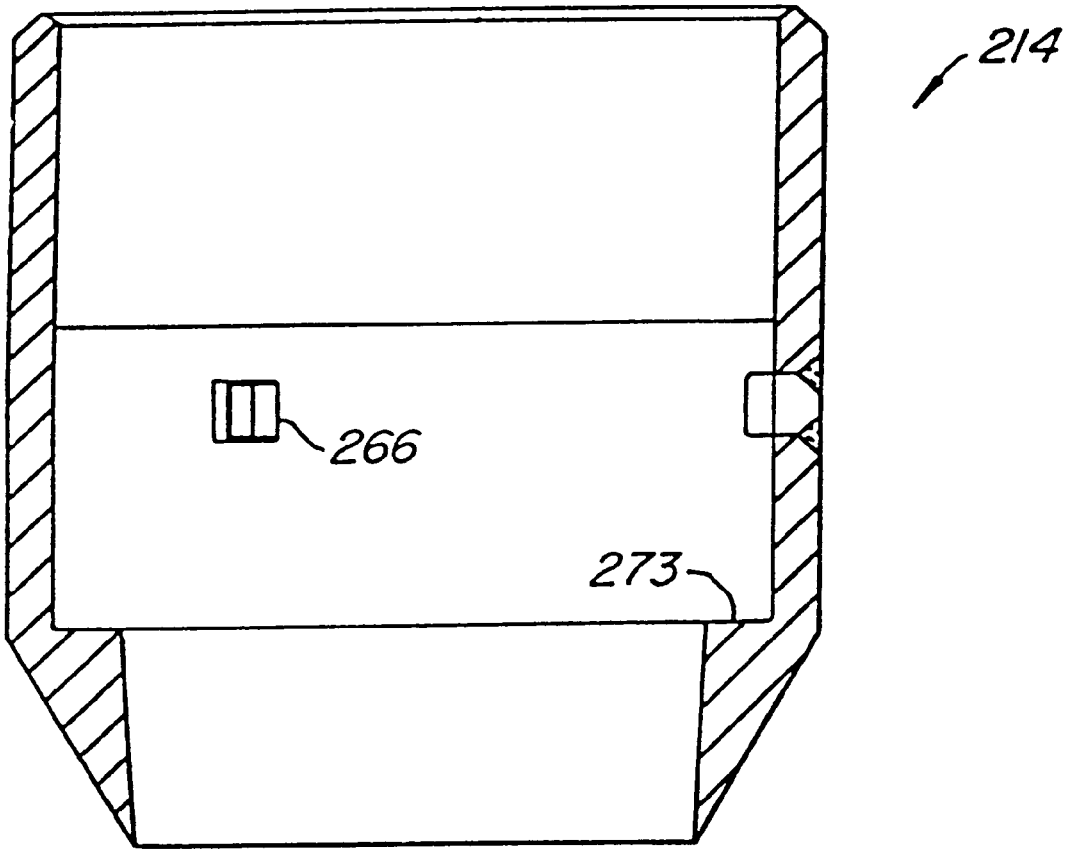
FIG. 13 is a cross-sectional view of the drive shoe for the third embodiment of the soil and fluid sampling device.

The drive shoe 214 is movably coupled to the inner ring 262 between a first position, in which the fluid entrance is covered, and a second position, in which the fluid entrance is exposed. FIG. 9 depicts the drive shoe 214 in both the first and second positions. The left hand side shows the drive shoe 214 in the first position while the right hand side shows the drive shoe 214 in the second position. As discussed below, the sampling device is lowered into the borehole and driven into the subsurface with the drive shoe in the first position to prevent cross-contamination of the fluid sample. The drive shoe is held in the first position by the o-ring. For additional assurance that the drive shoe will not move to the second position the elastic band 59 may also be positioned around the barrel covering part of the drive shoe and part of the sample tube 228.

The drive shoe 214 has pins 266 which engage pockets 268 in the inner ring 262. The pockets 268 include a slot 270 having an opening 272. The pin 266 is aligned with the opening 272 for installing and removing the drive shoe 214. When the drive shoe is in the first position a shoulder 273 of the drive shoe 214 contacts the inner ring 262 so that a longitudinal load on the drive shoe is transferred directly to the inner ring rather than to the pins 266. When the drive shoe 214 moves to the second position the pins 266 engage a bottom edge 270 of the pocket 268.

The sampling device 202 is lowered into the borehole with the drive shoe 214 in the first position. The sampling device 202 is then driven into the formation thereby forcing the soil sample into the hollow interior of the sampling device 202. The sampling device 202 is then pulled toward the uphole end. As the sampling device is pulled toward the uphole end the drive shoe frictionally engages the formation. The upward movement of the sampling device moves the drive shoe to the second position and exposes the fluid entrance 206. The fluid sample is then collected in the manner described below. The drive shoe 214 may be moved from the first position to the second position by many other methods. For example, the drive shoe may engage the inner ring with a screwed fitting whereby rotary motion of the barrel moves the drive shoe. The drive shoe may also be configured to move without requiring longitudinal movement of the sampling device 202. For example, the sampling device may include an uphole actuating mechanism for moving the drive shoe such as a wire, which can be pulled to move the drive shoe, a hydraulic line, or an electro-mechanical actuator.

The movable drive shoe 214 prevents fluid from entering the fluid entrance 206 until the sampling device is driven into the formation. Any other fluid flow preventing mechanism may also be used. For example, a sleeve may be provided which is movable independent of the drive shoe. The fluid flow preventing mechanism may also be a valve movable between the inner and outer surfaces at the fluid entrance 206. The fluid flow preventing mechanism may also be the elastic band 59 (FIG. 1).

The valve assembly 240 includes an outer body 243 and an inner body 246. The inner body 246 is welded to the first section 231 of the sample tube 228 and connected to the outer body at a threaded connection 247. The inner body 246 and first section 231 may also be formed together. The inner body 246 includes a semi-circumferential cut-out 249 which facilitates removal of the soil sample from the sampling device. After a soil sample is collected in the sampling device 202 the drive shoe 214 and inner ring 262 are removed so that the first and second sections 231, 233 of the sample tube 228 are no longer mechanically connected at the downhole end. The downhole end of the second section 233 is then rotated away from the soil sample with an upper edge 276 of the second section rotating into the cut-out 274. The second section 233 is then removed thereby exposing the soil sample. An upper end of the second section is wedge shaped, as depicted by broken line 251, so that the second section 233 can be rotated away from the first section. The valve assembly 240 also preferably includes a displaced air line 250 and a check valve 256 which operate in the same manner as air line 50 and check valve 56 described above.

The fluid entrance 206, which is preferably a plurality of fluid entrances, is positioned to penetrate the inner ring 262 of the barrel 204. An annular channel 232 is formed between the inner ring and the sample tube 232. The annular channel 228 is coupled to a longitudinal channel 230 extending from the downhole end of the sample tube to an outlet port 239. At the downhole end of the longitudinal channel 230 is a filter cavity 234 housing a filter 236. The filter 236 is preferably a fluid permeable membrane made by POREX®. The POREX® filter is preferably made of a porous plastic with an average mean pore size in the range of 10–150 microns with void volumes of 35–50%. The filter cavity 236 is slightly larger in cross-section than the longitudinal channel 230. A stainless steel tube (not shown) may be brazed into the longitudinal channel 230 to facilitate cleaning and resist corrosion.

The annular channel 232 and longitudinal channel 230 together define a fluid path 238. The fluid path 238 may take any form so long as it fluidly couples the fluid entrance 206 and the outlet port 239.

The outer body 243 includes a liquid sample path 265 and a gas sample path 267. The liquid sample path leads to a rod connection 244 which receives a rod used to drive the sampling device into the subsurface. The liquid and gas sample paths terminate at liquid and gas ports 269, 271. The port are adapted to receive a plug which seals the respective sample path.

The method of collecting fluid and soil samples of the present invention is described below in connection with the preferred embodiment of FIGS. 9–13. The method may, of course, be practiced using any device adapted to perform the steps as defined by the claims and is not limited to the specific embodiment described herein.

Figure 15:
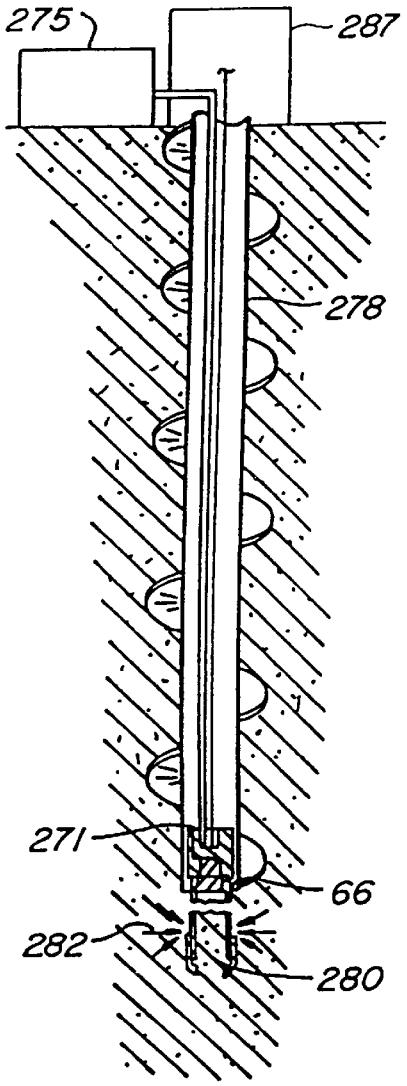
FIG. 15 shows the sampling device of FIGS. 9–13 driven into a subsurface for collecting a soil gas sample.

The sampling device 202 is decontaminated and configured in the desired sampling mode. If a soil gas sample is desired a vacuum pump 275 is coupled to the gas port 271 and a plug is inserted into the liquid port 269 (FIG. 15). The plug prevents prevent flow through the liquid port.

A borehole is drilled into the subsurface with a hollow stem auger 278 or any other drilling method. The hollow stem auger 278 advantageously minimizes cross-contamination in the borehole. If surface samples are desired a borehole is obviously not necessary. After the borehole is drilled to the desired depth the sampling device 202 is lowered into the hollow stem auger 278 to the bottom of the borehole.

The sampling device 202 is then driven into a terminal end 66 of the borehole with the drive shoe 214 in the first position. The sampling device is preferably driven into the subsurface with a wire line driven downhole hammer device 287 but may, of course, be driven into the subsurface by any other method. As the sampling device 202 is driven into the terminal end 66 a soil sample 280 is forced into the hollow interior 12.

After the sampling device 202 has been driven into the terminal end 66 of the borehole the sampling device is pulled toward the uphole end to move the drive shoe to the second position relative to the inner ring. Movement of the drive shoe exposes the fluid entrances 206. The vacuum pump 275 is then turned on to draw a soil gas sample into the fluid entrance 206 and through the fluid path 238. The soil gas flow into the fluid entrances 206 is depicted by arrows 282. After the soil gas sample has been collected the sampling device is recovered to obtain the soil sample.

If a liquid sample is desired the sampling device 202 is preferably configured as follows. A hollow rod 285 is inserted into the rod connection 244 and a plug is inserted into the gas port 271. The sampling device 202 is then driven into the subsurface by any conventional method and preferably by an uphole hammering device 286. The sampling device is pulled back toward the uphole end to move the drive shoe to the second position and expose the fluid entrances 206.

Figure 14:
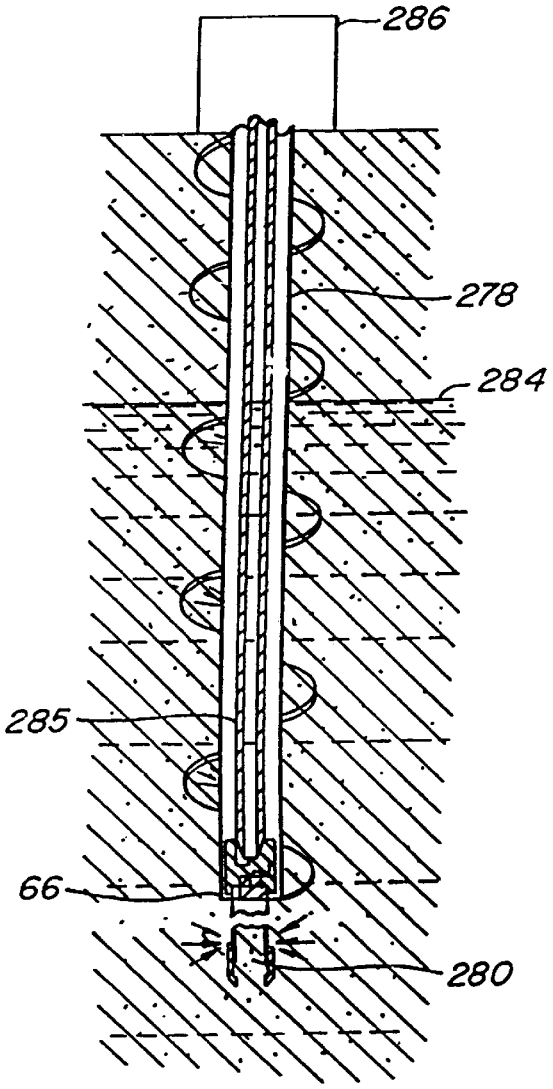
FIG. 14 shows the sampling device of FIGS. 9–13 driven into a subsurface for collecting a liquid sample.

Referring to FIG. 14, the liquid in the subsurface enters the fluid entrance and rises through the sampling device and into the hollow rod 285 under a potentiometric head 284 of the liquid in the formation (FIG. 14). A liquid collection device, such as a bailer, is lowered into the hollow rod 285 to obtain the liquid sample.

By collecting fluid and soil samples simultaneously, minimally disturbed samples are provided. In addition, the operating time required to collect both soil and fluid samples is decreased since only one downhole trip is necessary to collect fluid and soil samples.

A fourth sampling device 302 is shown in FIGS. 16–21. The sampling device 302 includes a sample barrel 304 having a drive shoe assembly 306 connected thereto at a downhole end 308. The sample barrel 304 includes an interior surface 307 and an exterior surface 309 defining a hollow interior 310 in which the soil sample is collected.

The sample barrel 304 includes a sample tube 312 which preferably has the same range of dimensions as the previously described embodiments. The sample tube 312 is preferably split longitudinally into first and second sections 314, 316 along split lines 318, one of which is shown in the cross-section of FIG. 16.

A core vent cover 320 is positioned between the first and second sections 314, 316 and seats against a sample tube head 322. The cover vent cover 320 has a groove 324 which receives an o-ring 326 engaging the interior surface 307 of the sample barrel 304. The cover vent cover 320 includes a displaced air passage 330 for air displaced by a soil sample entering the sample barrel 304.

The sample tube head 322 is preferably welded to the first section 316 of the sample tube 312. The sample tube head 322 includes a displaced air line 332 extending from an entrance port 334 to an exit port 336. The displaced air line 332 is coupled to the displaced air passage 330 of the core vent cover 320. A reed valve 338 is positioned along the displaced air line 332 which permits an air flow from the entrance port 334 to the exit port 336. A filter 340 covers the exit port 306 to prevent material from entering the displaced air line 332. The reed valve 338 is engaged by a nipple 342 of the core vent cover 320 to provide a substantially fluid tight seal therebetween. The reed valve 338 is essentially a one-way check valve and any other check valve may also be used without departing from the scope of the invention. The displaced air line 332 is provided for the reasons given above in connection with the previously described preferred embodiments.

A core sleeve 344, which is preferably formed by three separate six-inch cylindrical sections 345, fits within the sample barrel 304. The core sleeve 344 is known to those having skill in the art and is a conventional soil sampling tool. When the soil sample enters the sample barrel 304, the soil sample is received in the core sleeve 344. Since the core sleeve is generally composed of three separate six-inch sections 345, the connection 347 between each core sleeve provides a path through which fluid can escape from the soil sample.

In a further aspect of the present invention, the core sleeve 344 is completely encapsulated in a polyolefin shrink wrap 346 to help prevent pulling fluid from the soil sample during fluid sampling and also to limit off-gassing of the soil sample. The polyolefin shrink wrap also advantageously seals against the interior surface 307 along the split lines 318 to further reduce the likelihood of off-gassing of the soil sample. The top of the core sleeve 344 abuts against the o-ring 326 held by the core vent cover 320 to further prevent pulling fluid from the soil sample during fluid sampling. The shrink wrap 346 also provides a sanitary seal for the core sleeve 344 prior to sampling. The shrink wrap 346 is perforated adjacent the core vent cover 320 to permit passage of the displaced air from the sample barrel 304.

A circumferential fluid entrance 348 extends around the exterior surface of the barrel 304 for collecting the fluid sample. The fluid entrance 348 is formed by cutting a circumferential channel in the first and second sections 314, 316. The fluid entrance 348 may take any of the forms described above, however, the circumferential fluid entrance 348 is preferred since it advantageously admits fluid from all directions. The fluid entrance 348 is covered by a cylindrical screen 350. The screen 350 is preferably 50 mesh 321 stainless steel wire cloth having 0.009 inch wire diameter. The screen 350 is trapped between a shoulder 352 of the sample tube 312 and a screen retention collar 354 which is connected to the downhole end of the sample tube 312.

The fluid entrance 348 is fluidly coupled to two longitudinal channels 356 extending along the split lines 318 of the sample tube 312. The longitudinal channels 356 are formed by slots or grooves in the first and second sections 314, 316. Although it is preferred to provide two longitudinal channels 356, any number of channels may be provided. A removable polyethylene tube (not shown) is preferably positioned in each longitudinal channel 356 to facilitate cleaning. The polyethylene tubes preferably extend from the fluid entrance 348 to a recess 358 in the sample tube head 322. A preferred polyethylene tube has a 3/16 inch outer diameter and a 0.03 inch wall thickness. The polyethylene tubes preferably include fittings, as is known to those having skill in the art, at both ends to provide a substantially fluid tight engagement with the sample barrel 304 and the sample tube head 322.

Figure 16:
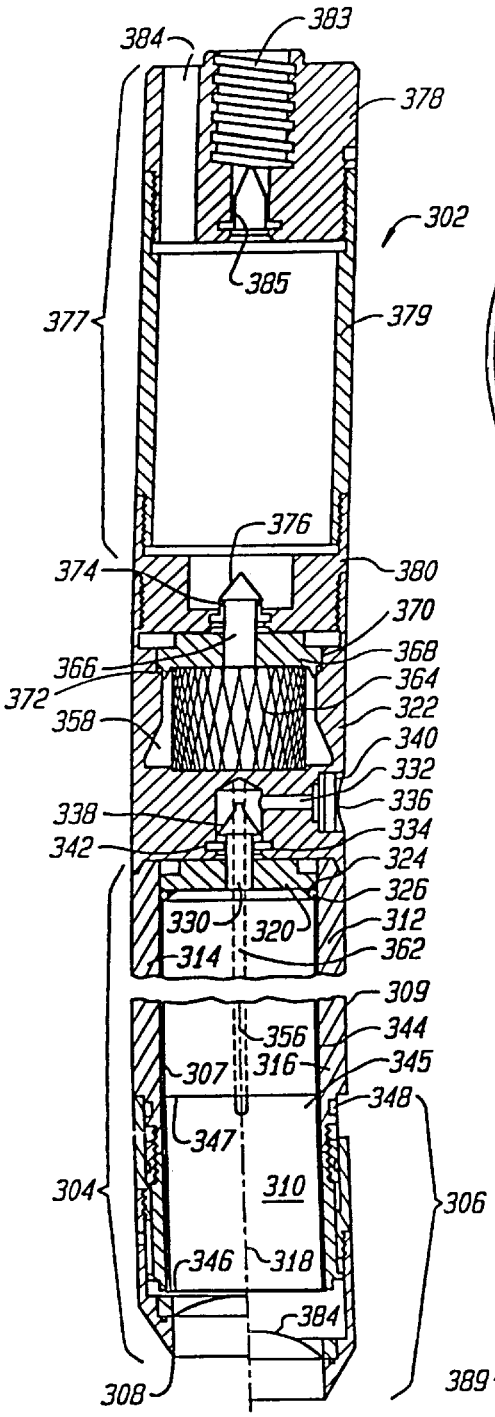
FIG. 16 is a cross-sectional view of a fourth sampling device.
Figure 17:
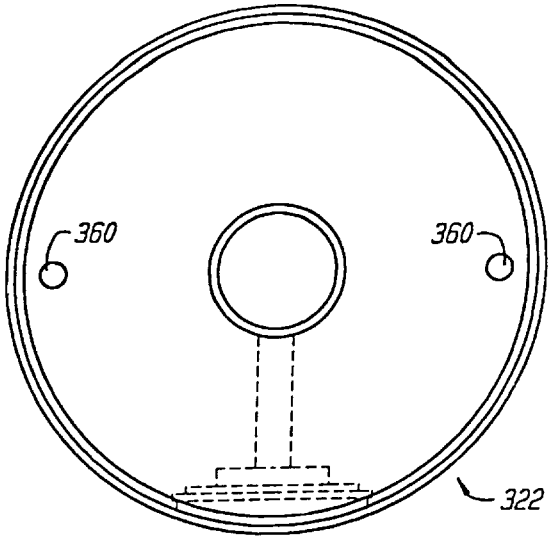
FIG. 17 is a bottom plan view of a valve body for the fourth sampling device of FIG. 16.

Referring to the plan view of FIG. 17, the sample tube head 322 includes two fluid passages 360 which are fluidly coupled to the longitudinal channels 356. Referring again to FIG. 16, the fluid passages 360 lead to the recess 358 formed in the sample tube head 322. A cylindrical filter 364 is positioned in the recess 358 to further filter the fluid flow. The filter 364 is preferably made of stainless steel. When collecting the fluid sample, the fluid flows into the recess 358 and radially inward through the cylindrical filter 364.

After passing through the cylindrical filter 364, the fluid flow passes through a centrally-located hole 366 in a cover 368 which encloses the uphole end of the sample tube head 322. The cover 368 is preferably the same as the core vent cover 320 to reduce manufacturing costs. Like the core vent cover 320, the cover 368 includes a groove 370 which receives an o-ring 372. The fluid passages 360, longitudinal channels 356, recess and hole 366 together define a fluid path 362. The fluid path 362 may also take any of the forms described above in the previously described preferred embodiments.

The fluid sample chamber 377 is enclosed by a fluid sampler head 378, a sidewall 379, and a fluid sampler bottom 380. The fluid sampler bottom 380 is threaded to the sample tube head 322. The fluid sampler bottom 380 includes a reed valve 376 which engages a nipple 374 of the cover 368. The reed valve 376 permits a fluid flow into the fluid sample chamber 377 and prevents fluid flow out of the fluid sample chamber 377.

The fluid sampler head 378 has a threaded connection 383 which receives a drive rod (not shown) for driving the sampling device 302 into the subsurface. The sampling device 302 may be driven into the subsurface using any of the methods described above or with any other method known to those having skill in the art. The fluid sampler head 378 includes a sensor port 384 and preferably at least three. The sensor port 384 is configured to receive various sensors for measuring various parameters such as pH, temperature, water level, specific conductance, dissolved oxygen, redox potential. Fiber optic sensors may also be used for analyzing organics in both gas and liquid phase as well as metals. During sampling, sensor ports 384 which are not used are plugged. The sensor ports 384 may also be used to collect the fluid sample by connecting a vacuum pump to the sensor port 384 when the fluid sample being retrieved is soil gas. A reed valve 385 is mounted to the fluid sampler head 378 and permits fluid flow out of the fluid sample chamber 377 through the threaded connection 383. The reed valve 385 may be used for discharging air displaced by fluid entering the fluid sample chamber 377. Alternatively, the displaced air in the fluid sample chamber 377 may be exhausted through a reed valve positioned in the sensor port 384. Yet another alternative is to provide an evacuated fluid sample chamber 377.

Although it is preferred to provide the fluid sample chamber 377, a hollow member may also be used in conjunction with a bailer to retrieve the fluid sample when the fluid sample desired is groundwater. The hollow member, which is preferably steel pipe, may be attached to either the fluid sampler head 378 or the sample tube head 322 for collecting the fluid sample.

Figure 18:
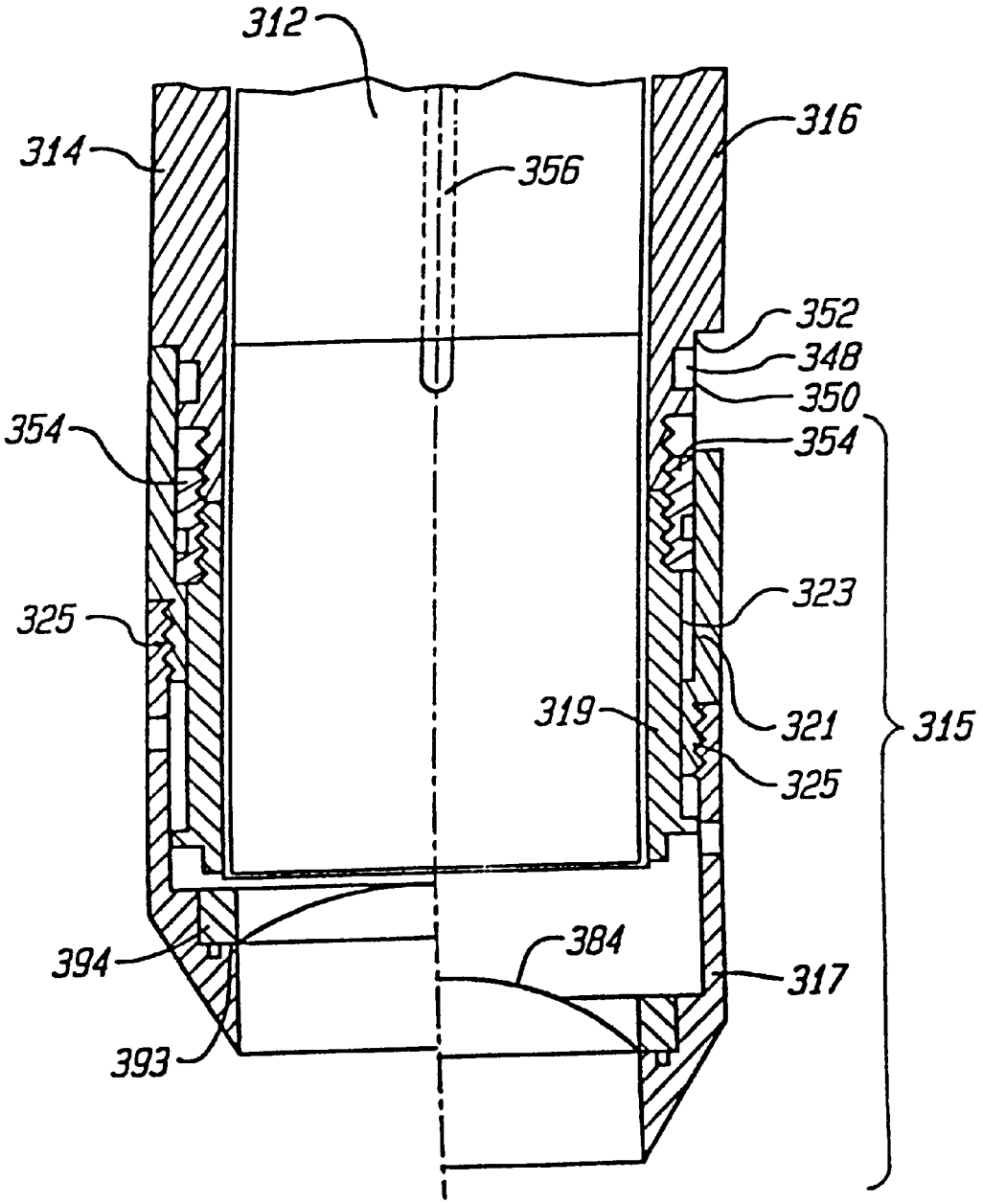
FIG. 18 is an enlarged view of the downhole end of the fourth sampling device of FIG. 16.

Referring now to FIG. 18, the drive shoe assembly 315 includes a drive shoe 317, an inner sleeve 319 and an outer sleeve 321. The inner sleeve 319 is connected, preferably by a threaded connection, to the screen retention collar 354 which together define a cylindrical recess 323. The drive shoe 315 and inner sleeve 319 are connected to one another and form a cylindrical ledge 325 which is positioned within the cylindrical recess 323. The ledge 325 and recess 323 limit movement of the drive shoe 317 between first and second positions as described below. The drive shoe 317 is preferably made of SAE 4140 steel and heat treated to Rc 38-40.

Referring again to FIG. 16, the drive shoe 315 and outer sleeve 321 are movable between a first position, in which the fluid entrance 348 is covered, and a second position, in which the fluid entrance 348 is exposed. The left-hand side of the drive shoe 317 in FIG. 16 shows the drive shoe 317 in the first position and the right-hand side shows the drive shoe 317 in the second position. The elastic band 59 (FIG. 1) may also be provided between the sample tube 312 and drive shoe assembly 315 to keep the drive shoe 317 in the first position when the sampling device 302 is lowered into the borehole or well.

A diaphragm 384 is preferably positioned adjacent an open end of the drive shoe 317 to prevent fluid and soil from entering the sample barrel 304 before the sampling device 302 is driven into the subsurface. Referring to the cross-sectional view of FIG. 19, the diaphragm 384 preferably includes a substantially circular perimeter 385, a central portion 386, and a lip 387. The lip 387 extends from the perimeter 385 and includes an annular portion 388 and a cylindrical portion 389. The cylindrical portion 389 is preferably continuous but may also include a number of individual tabs. The cylindrical portion 389 extends substantially parallel to a longitudinal axis 390 defined by the perimeter 385 and is preferably curved when viewed along a plane containing the longitudinal axis 390, however, the central portion 386 may also be flat or angled.

Figure 20:
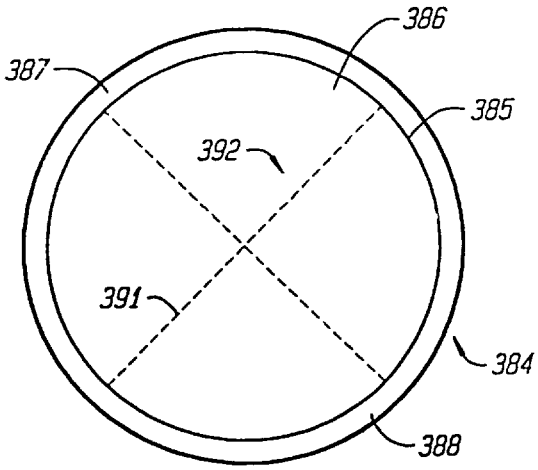
FIG. 20 is a plan view of the diaphragm of FIG. 19.
Figure 19:
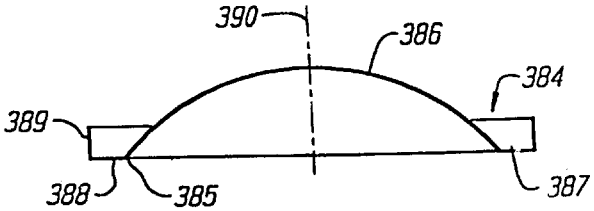
FIG. 19 is a cross-sectional view of a diaphragm.

Referring to the plan view of FIG. 20, the diaphragm 384 includes two radially-extending scores 391 which tear apart when the sampling device 302 is driven into the subsurface. When the diaphragm 384 is torn by the soil sample entering the barrel 304, four substantially triangular-shaped segments 392 are formed. The segments 392 advantageously help retain the soil sample in the interior of the sampling device 302 when the sampling device 302 is removed from the borehole. Although the radially-extending scores 391 are preferred, the diaphragm 384 may include other features which tear and, further, the features may be oriented in any other fashion. For example, the scores 391 may be circular, spiral or a number of parallel lines. Furthermore, the diaphragm may also be designed to tear into smaller pieces, rather than remain in one-piece, with the pieces being displaced into the barrel by the soil sample.

Referring again to FIG. 16, the diaphragm 384 rests against a lower ledge 393 of the drive shoe 317. The lip 387 receives a retainer 394 which holds the diaphragm 384 against the lower ledge 393 and provides tight engagement with the drive shoe 317. The lower ledge 393 has a groove 395 which receives an o-ring 396 to prevent fluid from passing around the diaphragm 384. A snap-ring may be provided (not shown) to help hold the diaphragm 384 in place, however, the snap-ring is not required.

The diaphragm 384 is preferably made of 38 gauge stainless steel but may also be made of any other suitable material. If the soil is relatively hard, the diaphragm 384 can be made of a rigid material without damaging or compressing the soil sample. The depth and length of the scores 391 can also be varied so that the force required to separate the segments is compatible with the type of formation being sampled. Furthermore, although it is preferred to provide a separate retainer 394, the retainer 394 and diaphragm 384 may also be formed as a single unit which is replaced after each sampling run. Finally, the diaphragm is preferably provided for all of the preferred embodiments described herein and, furthermore, may be used with any other type of soil sampling device to prevent cross-contamination of the soil sample.

Figure 21:
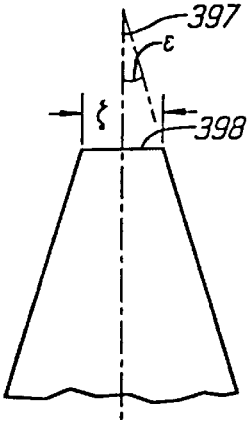
FIG. 21 shows a preferred thread arrangement for the fourth sampling device.

The various parts of the sampling device 302 which are threaded together preferably have stub Acme threads as shown in FIG. 21. The threads form an angle $\epsilon 0$ of 14.5 degrees with respect to a centerline 397 of the threads. A top 398 of the threads has a width $\zeta$ of preferably 0.047". Although the stub Acme threads are preferred, other thread arrangements may also be used with the sampling device 302.

The sampling device 302 is preferably cleaned and decontaminated before assembly so that sampling is not tainted. After being assembled, the sampling device 302 is then the operated in the manner described above in connection with the previously described preferred embodiments.

A fifth preferred sampling device 402 is shown in FIGS. 22–33. The sampling device 402 is adapted for use with the direct push method of sampling. A tip 403 is initially fixed to the remainder of the sampling device 402 for driving the sampling device to the desired sampling depth. At the desired sampling depth, the tip 403 is released and the sampling device 402 is then driven into the formation to admit the soil sample into the sampling device 402. Unlike the other sampling devices described above, a borehole is not required since the sampling device 402 may be driven directly into the subsurface to the desired sampling depth.

The sampling device 402 includes a barrel 404 having a drive shoe 406 mounted thereto at a downhole end 408. The barrel 404 has an exterior surface 410 and an interior surface 412 defining a hollow interior 414 in which the soil sample is collected. The barrel 404 includes first and second sections 416, 418 and a retention collar 420

Figure 23:
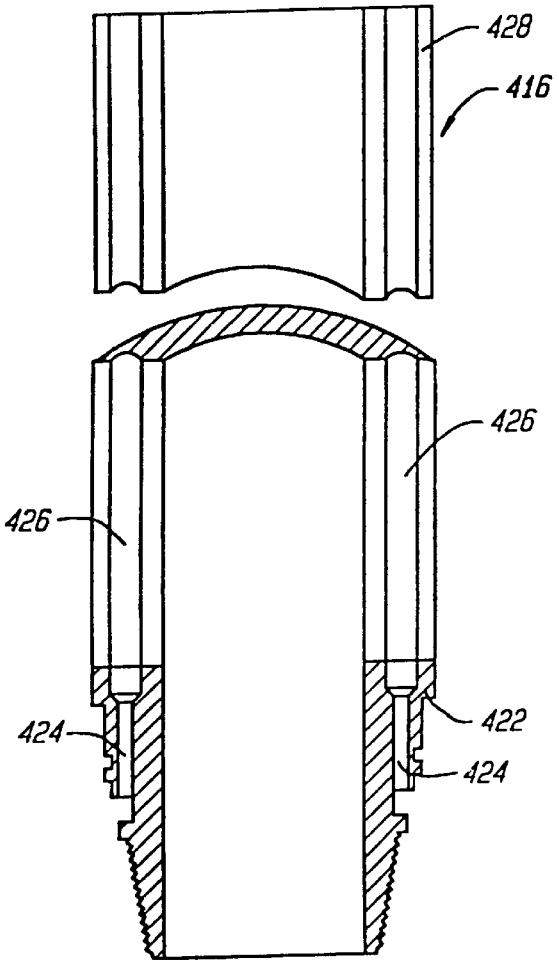
FIG. 23 is a cross-sectional view of a first section of a barrel for the fifth sampling device.
Figure 24:
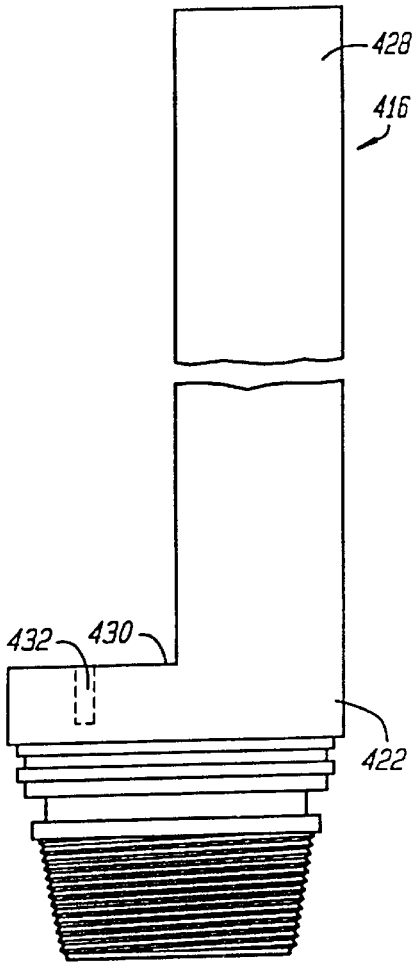
FIG. 24 is a side view of the first section of the barrel.
Figure 25:
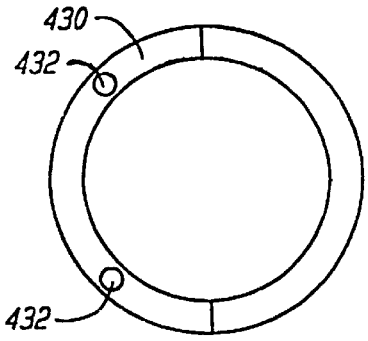
FIG. 25 is an end view of the first section of the barrel.

Referring to the cross-sectional view of FIG. 23, the first section 416 of the barrel 404 includes a lower portion 422 having holes 424 drilled therethrough. Longitudinal slots 426 are cut in an upper portion 428 of the first section 416 which are coupled to the holes 424. Referring to FIGS. 24 and 25, the first section 416 includes a bearing surface 430 having dowel pin holes 432 drilled therein. A dowel pin (not shown) is positioned in the dowel pin holes 432 for holding the first and second sections 416, 418 together.

Figure 26:
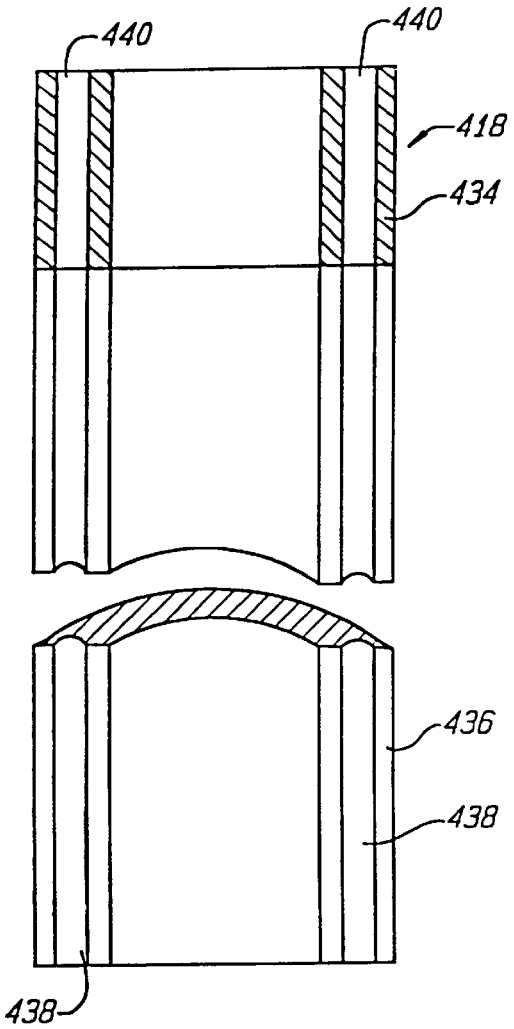
FIG. 26 is a cross-sectional view of a second section of the barrel.
Figure 27:
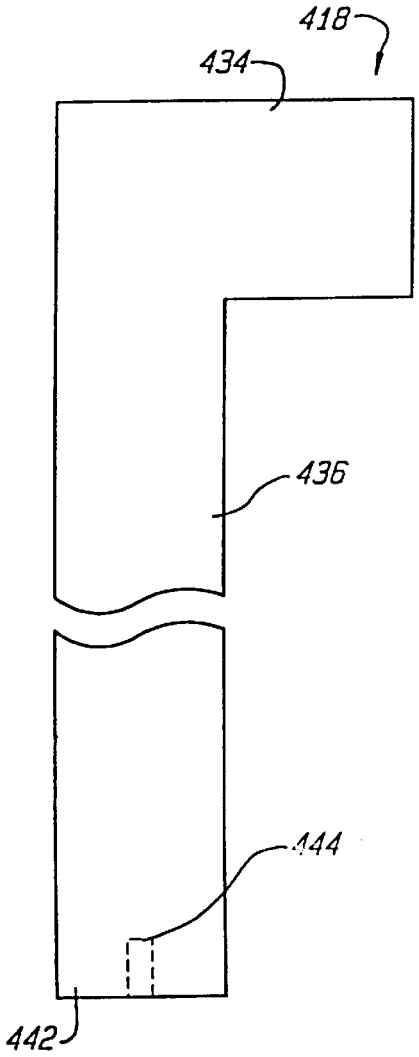
FIG. 27 is a side view of the second section of the barrel.
Figure 28:
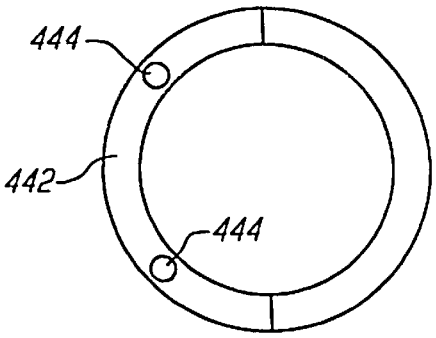
FIG. 28 is an end view of the second section of the barrel.

Referring to FIGS. 26 and 27, the second section 418 includes a substantially cylindrical upper portion 434 and a lower portion 436. The lower portion 436 is formed with slots 438 which engage the slots 426 in the first section 416. The upper portion 434 has holes 440 drilled therethrough which are coupled to the slots 438 in the lower portion 436. Referring to FIG. 28, the second section 418 also has a bearing surface 442 with dowel pin holes 444 drilled therein. The dowel pin (not shown) extends through the dowel pin holes 432, 444 in the first and second sections 416, 418. The sampling device 402 also preferably includes the encapsulated core sleeve (not shown) described above in connection with the sampling device 302.

Referring again to FIG. 22, a circumferential fluid entrance 446 extends around the exterior surface 410 of the barrel 404, however, the fluid entrance 446 may also take any of the forms described above. The fluid entrance 446 is covered by a cylindrical screen 448 which is preferably 50 mesh 321 stainless steel wire cloth having 0.009 inch wire diameter. The screen 448 is trapped between a shoulder 450 of the barrel 404 and the retention collar 420. The fluid entrance 446 is fluidly coupled to the holes 424 in the first section 416 of the barrel 404. The holes 424 and slots 426, 438 together define two longitudinal channels 452 extending from the fluid entrance 446. A removable polyethylene tube (not shown), as described above, is preferably positioned in each longitudinal channel 452 to facilitate cleaning. Although it is preferred to provide two longitudinal channels 452, any number of channels may be provided.

A barrel plug 454 seals an uphole end 469 of the barrel 404 and is preferably welded to the first section 416 of the barrel 404. The barrel plug 454 has a throughhole 456 in which is positioned a reed valve 458. The reed valve 458 permits a flow of air out of the barrel 404 but prevents air flow into the barrel 404. The barrel plug 454 has a displaced air line 460 which is provided for the reasons given above in connection with the sampling devices 2, 102, 202, 302. The uphole end of the barrel plug 454 is threaded to a drive coupling 462.

Figure 29:
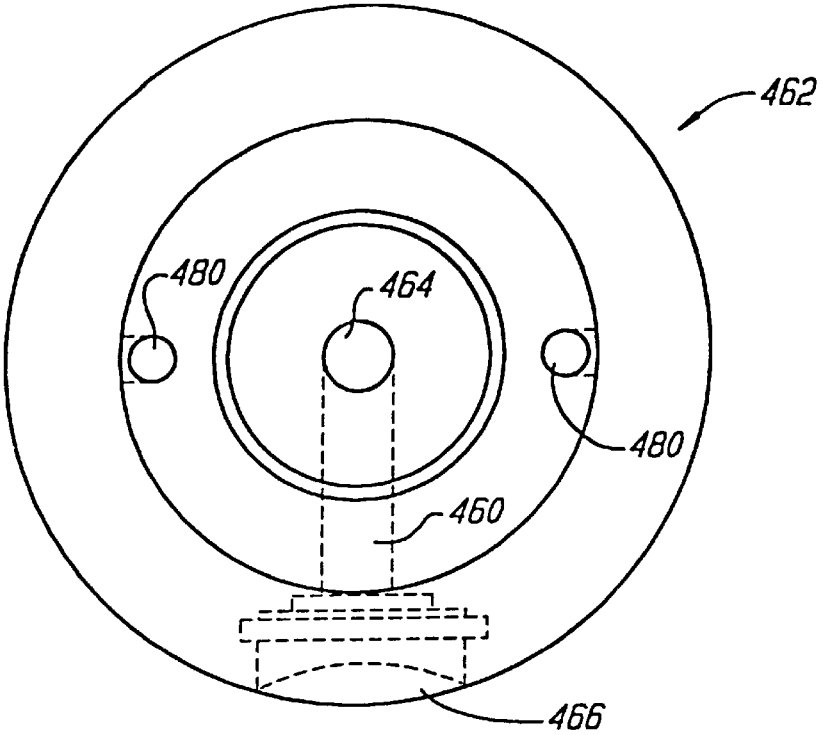
FIG. 29 is a plan view of a drive coupling for the fifth sampling device.

The drive coupling 462 has a passage 464 which is coupled to the throughhole 456 in the barrel plug 454. Referring to FIG. 29, the passage 464 is coupled to a displaced air exhaust port 466. A filter (not shown) is preferably positioned at the exhaust port 466 to prevent material from entering the displaced air line 460.

The drive coupling 462 has a threaded recess 468 which is configured to engage a hollow member (not shown), preferably a piece of pipe. The sampling device 402 is driven into the subsurface by applying a driving force to the hollow members in a manner known to those having skill in the art. As the sampling device 402 advances further into the subsurface, additional hollow members are added. The drive coupling 462 has a groove which receives an o-ring 472 to seal the connection between the drive coupling 462 and the barrel plug 454. The drive coupling 462 also includes a groove which receives an o-ring 476 to seal the connection between the drive coupling 462 and a spacer 478.

Figure 22:
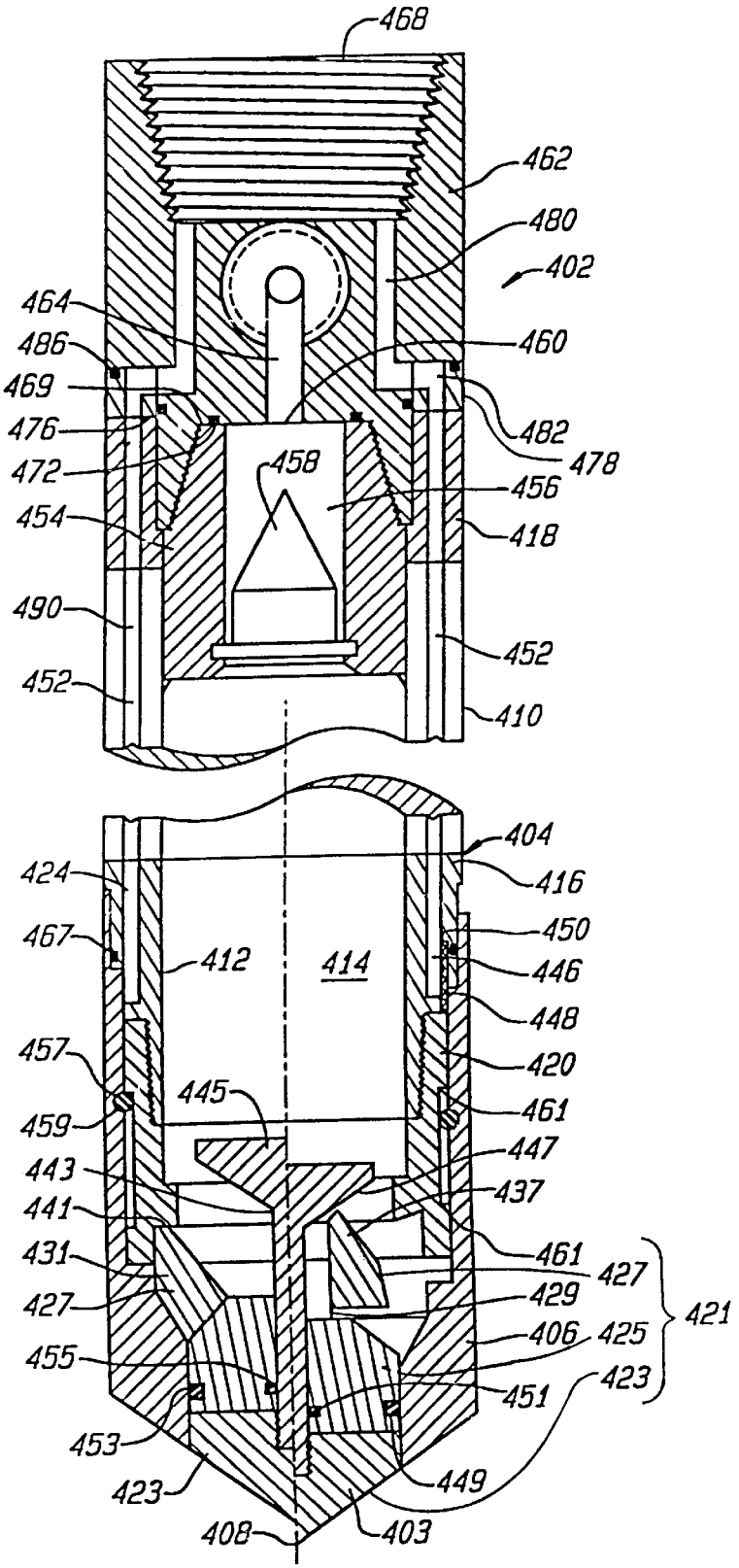
FIG. 22 is a cross-sectional view of a fifth sampling device.
Figure 30:
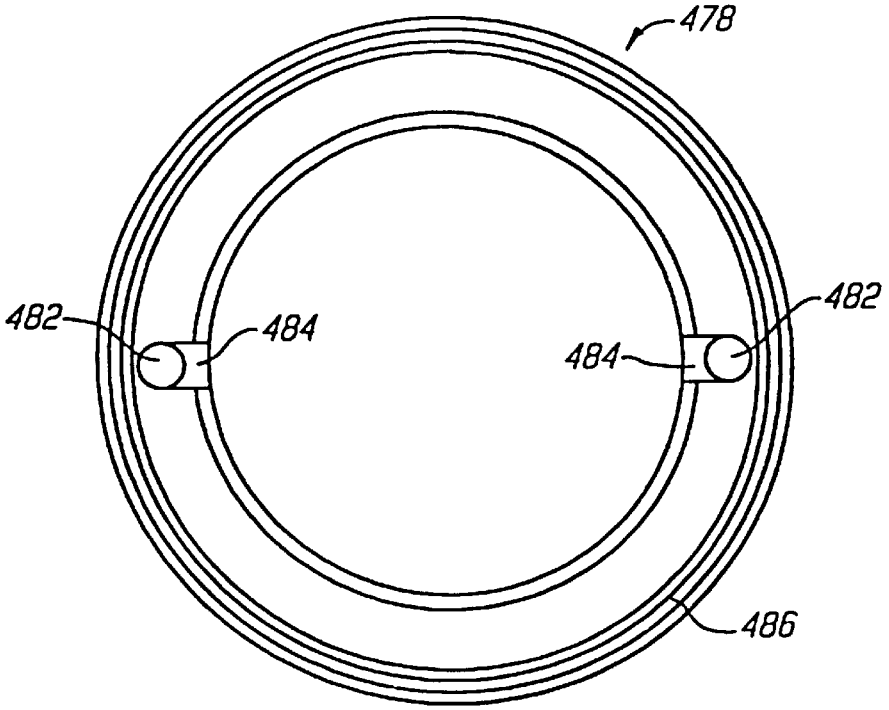
FIG. 30 is a plan view of a spacer for the fifth sampling device.
Figure 31:
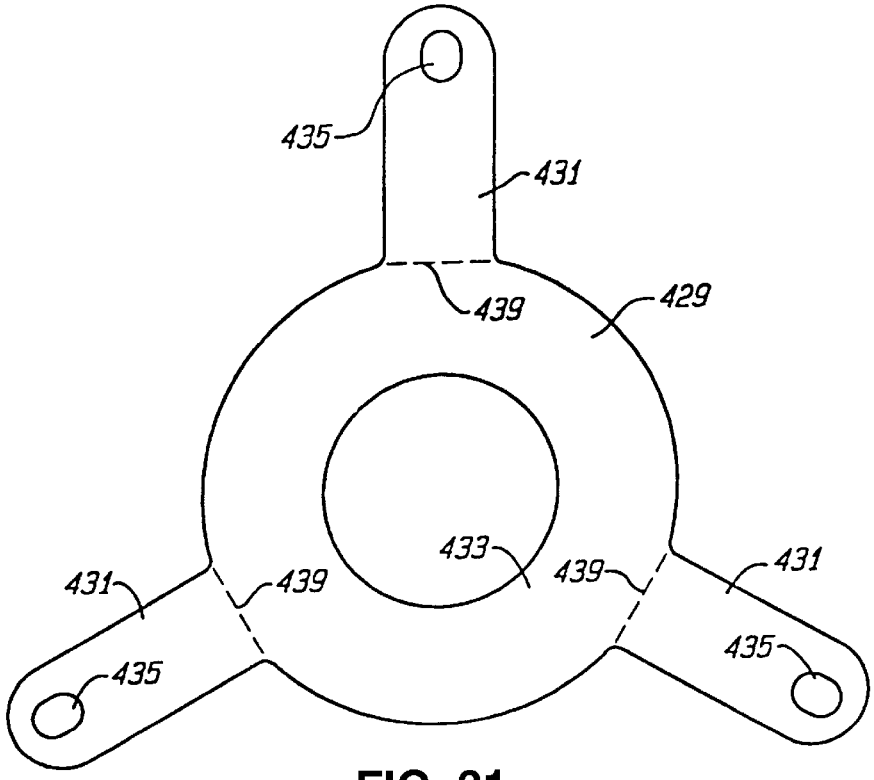
FIG. 31 is a plan view of a retractor for the fifth sampling device.

Referring to FIGS. 22 and 29, the drive coupling 462 has two channels 480 which extend toward the downhole end from the recess 468. The channels 480 are coupled to holes 482 in the spacer 478. Referring to FIG. 30, the spacer 478 has slots 484 cut radially inward from the holes 482 so that the holes 482 are in fluid communication with the channels 480 in the drive coupling 462. Referring again to FIG. 22, the spacer 478 also includes a groove 486 which receives an o-ring 488 to seal the connection between the drive coupling 462 and the spacer 478. The longitudinal channels 452, holes 482 and channels 480 together define a fluid path 490. The fluid path 490 and fluid entrance 446 may also take any of the forms described above.

The tip 421 includes a point 423, a base 425, and a releasing mechanism 427. The point 423 preferably includes a removable carbide tip (not shown) for facilitating penetration of the formation and to minimize wear of the point 423. The releasing mechanism 427 is movable between a locked position, in which the tip 421 is coupled to the barrel 404 for driving the sampling device 402 into the subsurface, and a released position, in which the tip 421 is displaceable toward the uphole end of the sampling device 402. The locked position is illustrated in the left-hand side of FIG. 22 and the released position is shown in the right-hand side of FIG. 22.

The releasing mechanism 427 includes a retractor 429 having three resilient arms 431. Referring to the plan view of FIG. 31, the arms 431 are integrally formed with a central portion 433. A preferred material for the retractor 429 is 22 Ga. spring steel. Each of the arms 431 has a throughhole 435 for attaching a contact 437 thereto with rivets (not shown). The arms 431 are folded along fold lines 439 to be perpendicular to the central portion 433 so that the natural, unbiased position of the arms is the released position shown in the left-hand side of FIG. 22.

The contacts 437 are preferably formed from a ring which is cut into three sections. The retractor 429 is preferably formed with three arms 431, however, any number of arms 431 may be provided. When the retractor 429 is in the locked position, as shown in the left-hand side of FIG. 22, the contacts 437 engage a stop 441 on the retention collar 420. In this manner, the tip 421 is drivingly coupled to the barrel 404 for driving the sampling device 402 into the subsurface. Although it is preferred to provide the arms 431 with separate contacts 437, the contacts 437 may be dispensed with and the arms 431 may contact the barrel 404 directly.

A point set 443 extends through the base 425 and has a threaded connection with the point 423. The point set 443 includes a head 445 having a frustoconical surface 447 facing the tip 421. The point set 443 is used for moving the releasing mechanism 427 to the locked position. During assembly of the sampling device 402, the point set 443 is pressed toward the downhole end so that the surface 447 engages the contacts 437 and forces the contacts 437 outward into the locked position.

The base 425 includes first and second o-ring grooves 449, 451 which receive first and second o-rings 453, 455. The first o-ring 453 seals space between the tip 421 and the drive shoe 406 and the second o-ring 455 seals a space between the tip 421 and the point set 443. The first o-ring provides a frictional engagement between the base 425 and the point set 443 so that the point set 443 does not slide toward the downhole end of the device. The second o-ring 455 provides frictional engagement between the tip 421 and the drive shoe 406 so that the tip 421 is not forced through the open end of the drive shoe 406 by the resilient forces of the retractor 429 when the releasing mechanism 427 is in the locked position.

Figure 32:
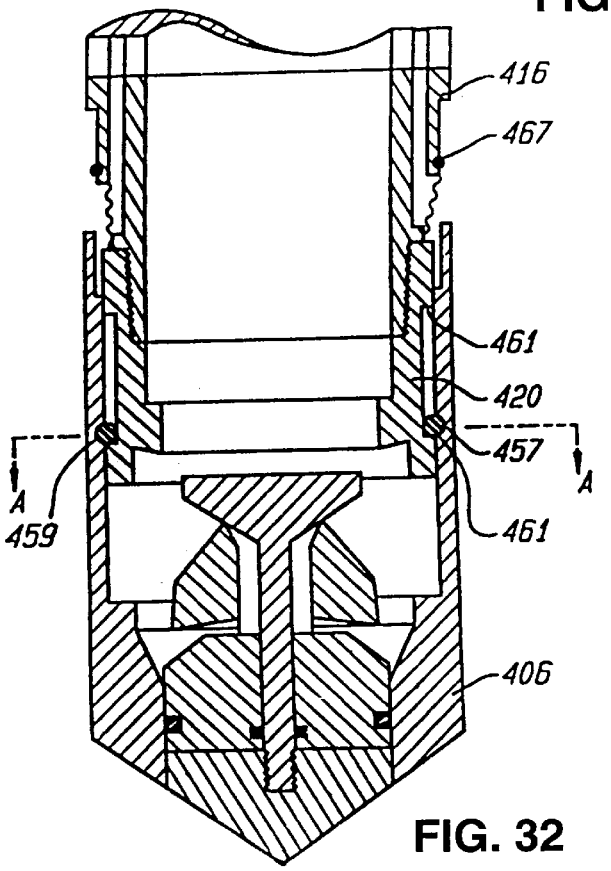
FIG. 32 shows a drive shoe of the fifth sampling device in a sampling position with a fluid entrance exposed for collecting a fluid sample.
Figure 33:
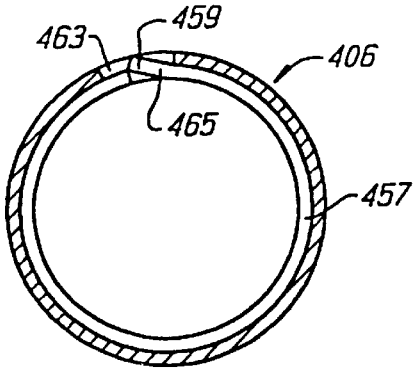
FIG. 33 is a cross-sectional view of the drive shoe of the fifth sampling device.

The drive shoe 406 is movable between three different positions; a driving position, in which the fluid entrance 446 is covered, a release position, in which the fluid entrance 446 is covered and the tip is released, and a sampling position, in which the fluid entrance 446 is exposed. The left-hand side of the drive shoe 406 in FIG. 22 depicts the drive shoe 406 in the driving position and the right-hand side depicts the drive shoe 406 in the release position. When the drive shoe 406 is in the release position, an o-ring 467 prevents fluid from entering the fluid entrance 446. Referring to FIG. 32, the drive shoe 406 is shown in the sampling position with the fluid entrance 446 exposed.

Referring again to FIG. 22, the drive shoe 406 preferably includes a groove 457 which receives a cord 459 preferably made of nylon. The cord 459, in conjunction with stops 461 on the retention collar 420, limits the movement of the drive shoe 406 between the driving and releasing positions. Referring to the cross-sectional view of the drive shoe 406 about line A—A, the drive shoe 406 includes an opening 463 communicating with the groove 457. When assembling the sampling device 402, the cord 459 is fed through the opening 463 and into the groove 457. The cord 459 is preferably sized a bit larger than the circumference of the groove 457 so that an overlapping portion 465 is provided around the opening 463 to make removing the cord 459 easier. By sizing the cord 459 in this manner, an end of the cord 459 is exposed for removing the cord 459 when disassembling the sampling device 402.

Use of the sampling device 402 is now described. The sampling device 402 is driven into the subsurface with the drive shoe 406 in the driving position and the retractors 429 in the first position so that the contacts 437 engage the stop 441 on the retention collar 420. The sampling device 402 is then driven into the subsurface to the desired sampling depth. Successive hollow members are added to the device to reach the desired sampling depth. The sampling device 402 is then pulled toward the uphole end to move the drive shoe 406 to the release position shown in the right-hand side of FIG. 22. The retractors 429 are biased inwardly to their natural, relaxed position and the contacts 437 are disengaged from the stop 441. The sampling device 402 is then driven into the subsurface so that a soil sample enters the barrel 404. As the soil sample enters the barrel 404, the tip 421 is displaced upwardly into the barrel 404 by the soil sample.

After the soil sample is in the barrel 404, the sampling device 402 is then pulled toward the uphole end so that the drive shoe 406 moves to the sampling position shown in FIG. 32 thereby exposing the fluid entrance 446. When the desired fluid sample is groundwater, the groundwater will rise through the fluid path 490 and into the recess 468. A bailer (not shown) is then lowered into the hollow members attached to the drive coupling to retrieve a groundwater sample as is known to one having skill in the art. After the groundwater sample has been retrieved, the sampling device is removed from the subsurface to retrieve the soil sample.

Although it is preferred to provide the fluid entrance 446 and fluid path 490, the sampling device 402 may also be configured for retrieving only the soil sample and the fluid entrance 446 and fluid path 490 may be dispensed with.

Furthermore, the sampling device 402 may be provided with the fluid sample chamber 377 of the sampling device 302 by attaching the fluid sample chamber 377 to the threaded recess 468.

Figure 34:
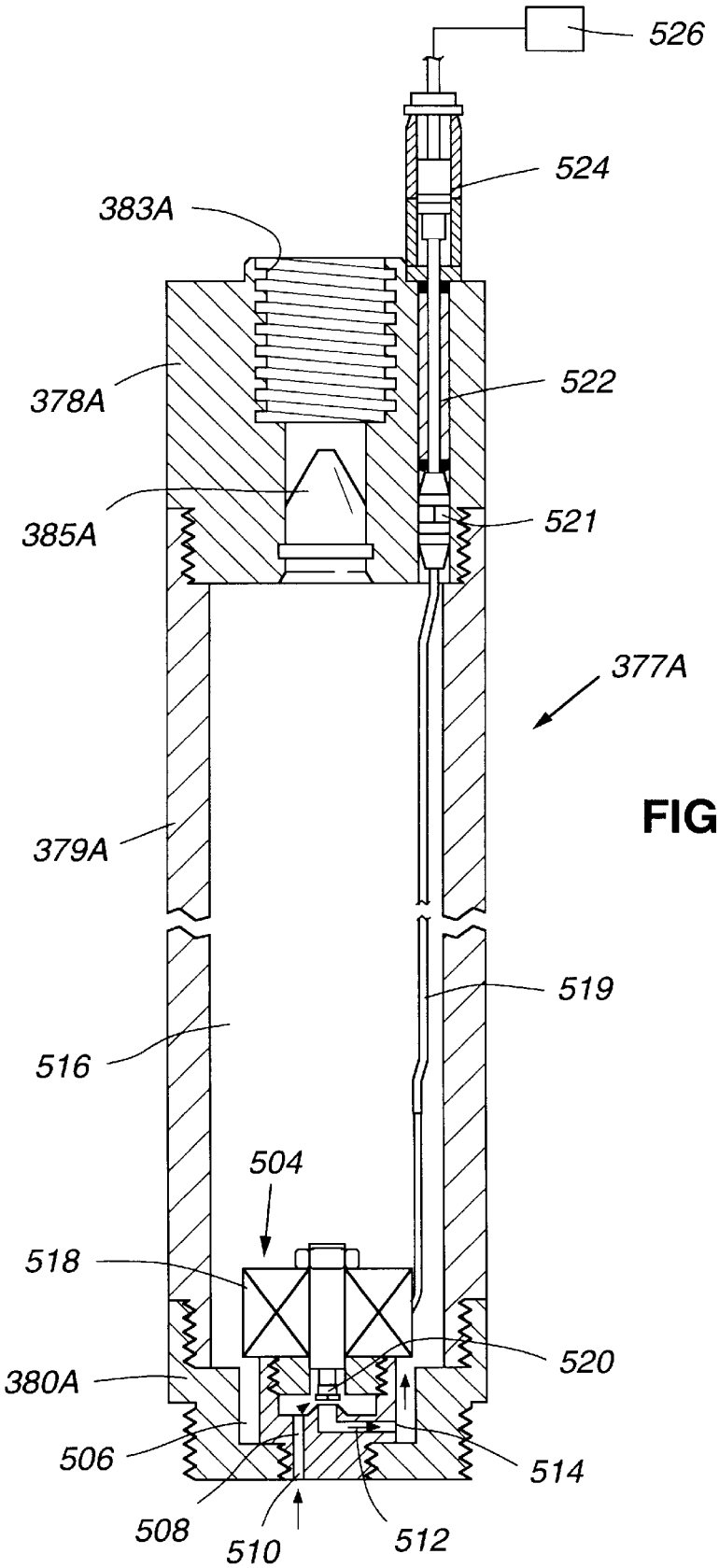
FIG. 34 is a cross-sectional view of a fluid canister adapted for use with the sampling devices of the present invention.

Referring to FIG. 34, an alternative fluid canister 377A is shown. The fluid canister 377A includes a fluid sampler head 378A, a sidewall 379A, and a fluid sampler bottom 380A. The fluid canister 377A is adapted for use with both the sampling device 302 of FIG. 16 and the sampling device 402 of FIG. 22. Referring to FIG. 16, the fluid canister 377A replaces the fluid sample chamber 377 which includes the fluid sampler head 378, sidewall 379 and fluid sampler bottom 380. Referring to FIG. 22, the fluid canister 377A may be coupled directly to the drive coupling 462 at the threaded recess 468 with the threaded recess 468 being configured to engage the threads of the fluid sampler bottom 380A.

The fluid sampler head 378A has a threaded connection 383A which receives a drive rod (not shown) for driving the sampling device into the subsurface. The sampling device may be driven into the subsurface using any of the methods described above or with any other method know to those of ordinary skill in the art. The fluid canister 377A also preferably includes sensor ports (not shown) which are described above in connection with the embodiment of FIG. 16. A reed valve 385A is mounted to the fluid sampler head 378A and permits fluid flow out of the fluid canister 377A through the threaded connection 383A. The reed valve 385A has the same function and alternatives as described above in connection with the embodiment of FIG. 16.

The fluid sampler bottom 380A includes a valve 504 mounted in a recess 506. The valve 504 is preferably releasable mounted to the bottom 380A so that the valve 504A may be decontaminated. The valve 504 has a fluid inlet 508 which is coupled to an opening 510 in the bottom 380A. A fluid path 512 leads from the inlet 508 to an exit 514 which is fluidly coupled to a fluid chamber 516. The fluid chamber 516 is used for collecting a fluid sample in the manner described above in connection with the embodiments of FIGS. 16 and 22.

The valve 504 preferably includes an electromagnetic valve assembly 518 for actuating a valve seat 520. The valve seat 520 is shown in the open position and is movable to a closed position which prevents fluid to flow through the valve 405. Although the valve assembly 518 is preferably a solenoid valve, the valve assembly 518 may be any other conventional valve such as a pneumatically actuated valve or a mechanically actuated valve. A cable 519 extends from the valve assembly 518 to a coupling 521 in the head 378A, A probe insert 522 is coupled to the outer end of the coupling 521. A liquid-tight electrical connection 524 is provided at the uphole end to prevent fluid from passing therethrough. The electrical connections, coupling 521 and liquid-tight connection 524 may be configured in any conventional manner as known to those having skill in the art. A remote actuator 526 is coupled to the cable 519 for actuating the valve assembly 518 from an uphole location.

Operation of a sampling device having the fluid canister 377A is the same as described above in connection with the embodiments of FIGS. 16 and 22 with the following exception. After the fluid sample has been collected in the fluid chamber 516, the remote actuator 526 is used to send an electrical signal to the valve assembly 518 for closing the seat 520. When the seat 520 is closed, fluid flow is prevented into the fluid chamber 516 through the valve 504. The valve 504 provides an improvement over simple check valves since the valve 504 prevents cross-contamination when the sampling device is removed through a borehole containing high density fluid which would otherwise displace the fluid sample out of the fluid chamber 516.

Modification and variation can be made to the disclosed embodiments without departing from the subject of the invention as defined by the following claims. For example, the exterior surface may be rectangular or irregularly shaped, the fluid entrance may be positioned at the uphole end rather than the downhole end, the flow path may be formed by an annular space between two concentric tubes, and any of the sampling devices may be provided with the tip 421 rather than simply the fifth sampling device 402. Furthermore, the scope of the invention as it pertains to environmental sampling is developed only as an example of one particular use for the invention. The method and apparatus of the present invention may, of course, be used to obtain samples for any other purpose such as oil, gas and geothermal exploration.

What is claimed is:

1. A method of collecting fluid samples, comprising the step of:

providing a sampling device having a groundwater collecting portion, the sampling device including a cylindrical barrel having interior and exterior surfaces, a fluid entrance in the interior and/or exterior surface of the barrel, and a valve, the valve being positioned along a fluid path between the fluid entrance and the groundwater collecting portion;

driving the sampling device into a subsurface to a sampling depth;

exposing the fluid entrance to groundwater in the subsurface;

collecting a fluid sample in the groundwater collecting portion, the fluid sample passing through the fluid entrance and the valve;

obstructing fluid flow through the fluid entrance with a rigid member before the collecting step;

closing the valve after the collecting step and preventing both fluid flow into and fluid flow out of the groundwater collecting portion through the valve after the collecting step; and removing the sampling device from the subsurface.

2. The method of claim 1, wherein:

the obstructing step is carried out by providing a movable drive shoe, the drive shoe being movable between a first position, in which the drive shoe covers the fluid entrance, and a second position, in which the drive shoe is spaced apart from the fluid entrance.

3. The method of claim 1, further comprising the step of:

separating the groundwater collecting portion from a remainder of the sampling device after the removing step.

4. A method of collecting fluid samples, comprising the steps of:

providing a sampling device having a groundwater collecting portion, the sampling device having a fluid entrance, a drive shoe movable between a first position in which the drive shoe covers the fluid entrance, and a second position in which the drive shoe is spaced apart from the fluid entrance, and a valve positioned along a fluid path between the fluid entrance and the groundwater collecting portion;

driving the sampling device into a subsurface to a sampling depth;

pulling the sampling device toward an uphole end so that the drive shoe moves from the first position to the second position to expose the fluid entrance to groundwater in the subsurface;

preventing a fluid flow through the fluid entrance using the drive shoe;

after the preventing step, collecting a fluid sample in the groundwater collecting portion, the fluid sample passing through the fluid entrance and the valve;

closing the valve after the collecting step and preventing both fluid flow into and fluid flow out of the groundwater collecting portion through the valve after the collecting step;

removing the sampling device from the subsurface.

5. A fluid sampling device comprising:

a cylindrical barrel including a groundwater collecting portion and interior and exterior surfaces;

a fluid entrance in the interior and/or exterior surface of the barrel and fluidly coupled to the groundwater collecting portion;

a rigid slidable cover having a first position covering the fluid entrance to prevent fluid flow through the fluid entrance and a second position in which the fluid entrance is at least partially exposed to permit fluid flow through the fluid entrance; and a valve positioned between the fluid entrance and the groundwater collecting portion, the valve being movable between an open position and a closed position, the valve preventing a fluid flow therethrough when in the closed position.

6. The sampling device of claim 5, wherein:

the valve includes a remote actuator configured to move the valve from the open position to the closed position.

7. A fluid sampling device comprising:

a barrel including a groundwater collecting portion the barrel including a soil sampling chamber having an opening;

a fluid entrance in the barrel fluidly coupled to the groundwater collecting portion;

a moveable cover having a first position covering the fluid entrance to prevent fluid flow through the fluid entrance and a second position in which the fluid entrance is at least partially exposed to permit fluid flow through the fluid entrance;

a valve positioned between the fluid entrance and the groundwater collecting portion, the valve being movable between an open position and a closed position, the valve preventing a fluid flow therethrough when in the closed position; and a tip having a releasing mechanism movable between a first position and a second position, the tip covering the opening in the soil sampling chamber when the releasing mechanism is in the first position, the tip being displaceable from the open end when the releasing mechanism is in the second position.

8. A method of collecting fluid samples, comprising the steps of:

providing a cylindrical barrel having a groundwater collecting portion, a fluid entrance, a drive shoe movable between a first position in which the drive shoe covers the fluid entrance, and a second position in which the drive shoe is spaced apart from the fluid entrance, and a valve positioned along a fluid path between the fluid entrance and the groundwater collecting portion;

driving the sampling device into a subsurface to a sampling depth;

exposing the fluid entrance to groundwater in the subsurface;

preventing a fluid flow through the fluid entrance using the drive shoe;

after the preventing step, collecting a fluid sample in the groundwater collecting portion, the fluid sample passing through the fluid entrance and the valve;

closing the valve after the collecting step and preventing both fluid flow into and fluid flow out of the groundwater collecting portion through the valve after the collecting step; and removing the sampling device from the subsurface.

9. A method of collecting fluid samples and soil samples, comprising the steps of:

providing a sampling device having a soil sample chamber a groundwater collecting portion, the sampling device having a fluid entrance, a drive shoe movable between a first position in which the drive shoe covers the fluid entrance, and a second position in which the drive shoe is spaced apart from the fluid entrance, and a valve positioned along a fluid path between the fluid entrance and the groundwater collecting portion;

driving the sampling device into a subsurface to a sampling depth;

collecting a soil sample in the soil sample chamber;

exposing the fluid entrance to groundwater in the subsurface;

preventing a fluid flow through the fluid entrance using the drive shoe;

after the preventing stem collecting a fluid sample in the groundwater collecting portion, the fluid sample passing through the fluid entrance and the valve;

closing the valve after the collecting step and preventing both fluid flow into and fluid flow out of the groundwater collecting portion through the valve after the collecting step; and removing the sampling device from the subsurface.

10. The method according to claim 9 wherein:

the soil sample chamber provided in the providing step includes an opening, and wherein the providing step further provides a moveable drive cone having a first position covering the opening and a second position separated from the opening; and the step of collecting a soil sample includes the steps of moving the drive cone from the first to the second position and driving the sampling device into the subsurface.

* * * * *